US009988231B2

(12) United States Patent
Nakano et al.

(10) Patent No.: US 9,988,231 B2
(45) Date of Patent: Jun. 5, 2018

(54) SHEET CONVEYING APPARATUS AND IMAGE FORMING SYSTEM INCLUDING THE SAME

(71) Applicant: CANON FINETECH NISCA INC., Misato-shi (JP)

(72) Inventors: Takahiro Nakano, Minamikoma-gun (JP); Daiki Komiyama, Minamikoma-gun (JP); Noritoshi Aikawa, Minamikoma-gun (JP)

(73) Assignee: Canon Finetech Nisca Inc., Misato-shi (JP)

( * ) Notice: Subject to any disclaimer, the term of this patent is extended or adjusted under 35 U.S.C. 154(b) by 0 days. days.

(21) Appl. No.: 15/257,010

(22) Filed: Sep. 6, 2016

(65) Prior Publication Data

US 2017/0068202 A1 Mar. 9, 2017

(30) Foreign Application Priority Data

Sep. 9, 2015 (JP) ..... 2015-178019

(51) Int. Cl.
*B65H 31/02* (2006.01)
*B65H 29/24* (2006.01)
(Continued)

(52) U.S. Cl.
CPC ..... *B65H 29/242* (2013.01); *B65H 29/145* (2013.01); *B65H 29/26* (2013.01); *B65H 29/34* (2013.01); *B65H 29/52* (2013.01); *B65H 29/54* (2013.01); *B65H 31/02* (2013.01); *B65H 31/3018* (2013.01); *B65H 31/3027* (2013.01);
(Continued)

(58) Field of Classification Search
CPC .... B65H 29/34; B65H 31/3018; B65H 31/32; B65H 2801/24; B65H 2801/27; B65H 2404/693; B56H 31/3009
See application file for complete search history.

(56) References Cited

U.S. PATENT DOCUMENTS 5,971,384 A * 10/1999 Asao ..... B42C 1/12 270/58.01
6,290,220 B1 * 9/2001 Takehara ..... B42C 1/12 270/58.08
(Continued)

FOREIGN PATENT DOCUMENTS

JP 2004-269252 A 9/2004

*Primary Examiner* — Jeremy R Severson
(74) *Attorney, Agent, or Firm* — Fitzpatrick, Cella, Harper & Scinto

(57) ABSTRACT

A sheet conveying apparatus, including: a support portion configured to support a second sheet different from a first sheet among a plurality of sheets when the first sheet located undermost among the plurality of sheets conveyed by a conveyance portion is placeable on a placement portion; and a restriction unit configured to bring the second sheet into a first state in order to restrict downward movement of the second sheet at a restriction position located downstream of a support position at which the support portion supports the second sheet when the first sheet is placeable on the placement portion, and to bring the second sheet into a second state in order to remove or reduce a restriction force for restricting the downward movement of the second sheet to less than a restriction force in the first state after bringing the second sheet into the first state at the restriction position.

9 Claims, 22 Drawing Sheets

(51) Int. Cl.

| | |
|---|---|
| ***B65H 29/54*** | (2006.01) |
| ***B65H 29/34*** | (2006.01) |
| ***G03G 15/00*** | (2006.01) |
| ***B65H 29/14*** | (2006.01) |
| ***B65H 29/26*** | (2006.01) |
| ***B65H 29/52*** | (2006.01) |
| ***B65H 31/30*** | (2006.01) |
| ***B65H 31/32*** | (2006.01) |
| ***B65H 31/36*** | (2006.01) |

(52) U.S. Cl.

CPC ..... *B65H 31/3045* (2013.01); *B65H 31/3081* (2013.01); *B65H 31/32* (2013.01); *B65H 31/36* (2013.01); *G03G 15/6538* (2013.01); *B65H 2301/4212* (2013.01); *B65H 2301/4213* (2013.01); *B65H 2403/942* (2013.01); *B65H 2404/1521* (2013.01); *B65H 2404/2641* (2013.01); *B65H 2404/691* (2013.01); *B65H 2404/693* (2013.01); *B65H 2405/11151* (2013.01); *B65H 2406/323* (2013.01); *B65H 2801/27* (2013.01); *G03G 2215/00827* (2013.01); *G03G 2215/00877* (2013.01)

(56) References Cited

U.S. PATENT DOCUMENTS

| | | | | |
|---|---|---|---|---|
| 7,624,976 | B2 * | 12/2009 | Koie | B42C 1/12 270/58.02 |
| 7,690,636 | B2 * | 4/2010 | Noh | G03G 15/6573 270/58.07 |
| 9,278,571 | B2 * | 3/2016 | Abe | B65H 37/04 |
| 2004/0175217 | A1 | 9/2004 | Nakamura et al. | |
| 2007/0057434 | A1 | 3/2007 | Nakamura et al. | |
| 2008/0143034 | A1 | 6/2008 | Nakamura et al. | |

* cited by examiner

SHEET CONVEYING APPARATUS AND IMAGE FORMING SYSTEM INCLUDING THE SAME

BACKGROUND OF THE INVENTION

Field of the Invention

The present invention relates to a sheet conveying apparatus configured to convey a single sheet or a bundle of sheets fed from, for example, an image forming apparatus. The present invention also relates to an image forming system including the sheet conveying apparatus.

Description of the Related Art

Hitherto, there have been provided image forming systems in which image forming apparatuses such as a copying machine, a printer, a facsimile machine, and a multifunction peripheral thereof are connected to post-processing apparatuses configured to perform various kinds of post-processing including sorting, aligning, binding, folding, and punching on sheets discharged from the image forming apparatuses. Those post-processing apparatuses are each configured to stack sheets from the image forming apparatuses on a processing tray, perform the post-processing, and then discharge the sheets onto a stacking tray.

As such a post-processing apparatus, there is known an apparatus having a buffering function to cause a succeeding sheet to temporarily remain on an upstream side of the processing tray so as to prevent the succeeding sheet from being conveyed to the processing tray where a preceding sheet undergoes post-processing, thus preventing the succeeding sheet from striking against the sheet during the post-processing or hindering the post-processing (see, for example, Japanese Patent Application Laid-Open No. 2004-269252). In the sheet processing apparatus described in Japanese Patent Application Laid-Open No. 2004-269252, a buffered succeeding sheet is overlaid on a post-processed sheet to be discharged onto the stacking tray from the processing tray with a slight displacement in a direction of discharge, and the sheets are integrally conveyed in a carry-out direction to cause the lower-side post-processed sheet to naturally fall on the stacking tray. After that, the succeeding sheet is conveyed in an opposite direction to be placed on the processing tray, thereby achieving further improvement of productivity.

In the conventional apparatus described in Japanese Patent Application Laid-Open No. 2004-269252, a post-processed sheet (or bundle of sheets) is caused to fall on the stacking tray under its own weight. Therefore, when the post-processed sheet and its succeeding sheet (or bundle of sheets) to be overlaid thereon are attracted to each other by static electricity, the post-processed sheet may adhere to the succeeding sheet and not be properly separated therefrom.

SUMMARY OF THE INVENTION

The present invention provides a sheet conveying apparatus configured to facilitate separation of a first sheet located undermost among a plurality of sheets overlaid on top of each other from a second sheet.

According to one embodiment of the present invention, there is provided a sheet conveying apparatus, comprising:

a conveyance portion configured to convey a plurality of sheets in a predetermined direction, the plurality of sheets being overlaid on top of each other, the plurality of sheets including a first sheet and a second sheet, the first sheet being located undermost among the plurality of sheets, the second sheet being different from the first sheet;

a placement portion on which the plurality of sheets conveyed by the conveyance portion is placed;

a support portion configured to support the second sheet when the first sheet is located at a position at which the first sheet is placeable on the placement portion, an upstream edge of the first sheet being located downstream of an upstream edge of the second sheet in the predetermined direction; and a restriction unit configured to bring the second sheet into a first state in order to restrict downward movement of the second sheet at a restriction position located downstream of a support position at which the support portion supports the second sheet in the predetermined direction when the first sheet reaches the position at which the first sheet is placeable on the placement portion, and to bring the second sheet into a second state in order to remove or reduce a restriction force for restricting the downward movement of the second sheet to less than a restriction force in the first state after bringing the second sheet into the first state at the restriction position.

Further features of the present invention will become apparent from the following description of exemplary embodiments with reference to the attached drawings.

DESCRIPTION OF THE EMBODIMENTS

Now, with reference to the attached drawings, exemplary embodiments of the present invention will be described in detail. Note that, in the attached drawings, the same or similar components are denoted by the same reference symbols in the entire specification.

Figure 1:
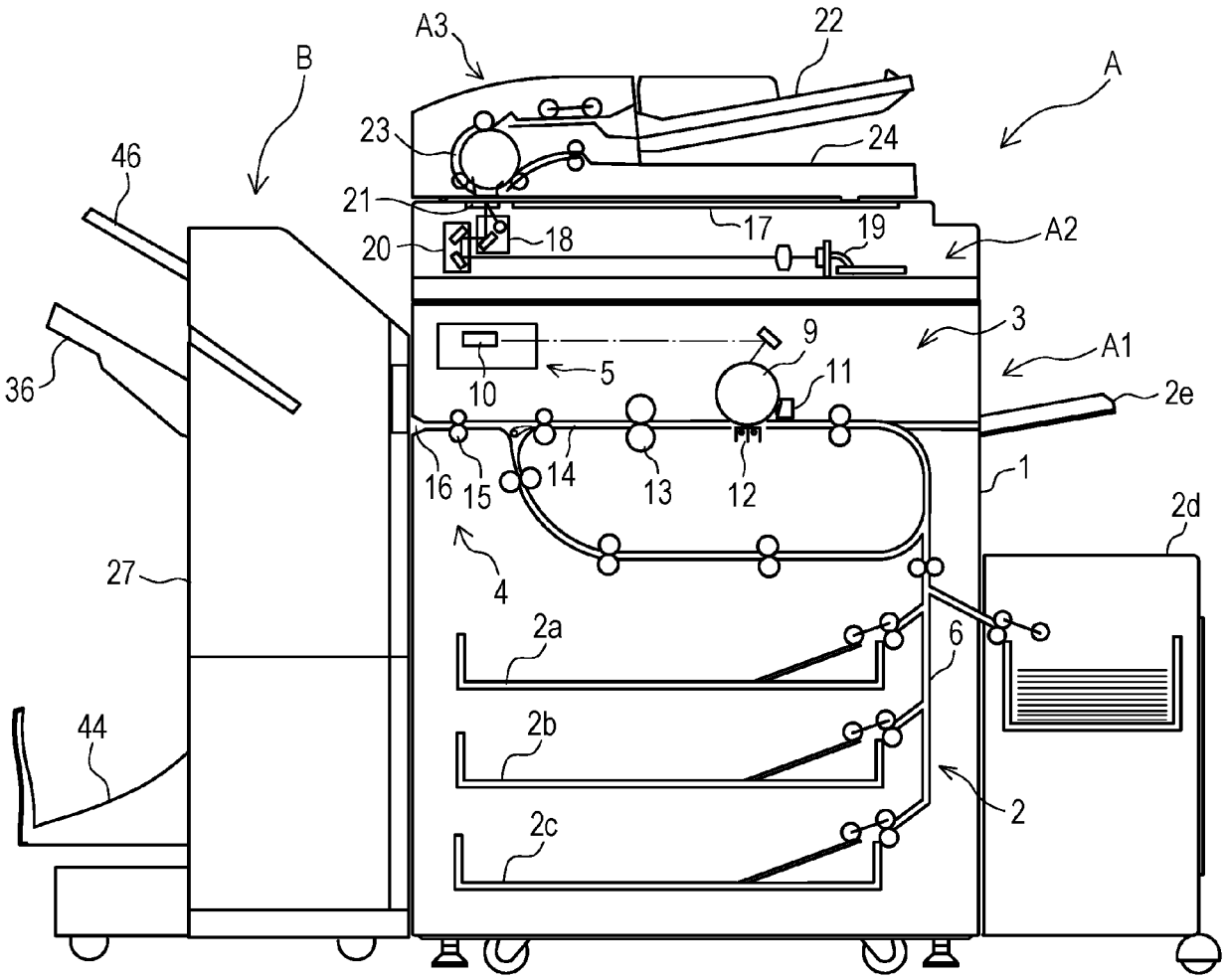
FIG. 1 is an explanatory view of the overall structure of an image forming system according to an embodiment.

The overall structure of an image forming system including a sheet conveying apparatus of the embodiment is schematically illustrated in FIG. 1. As illustrated in FIG. 1, an image forming system 100 includes an image forming apparatus A and a sheet post-processing apparatus B juxtaposed to the image forming apparatus A. The image forming apparatus A includes an image forming unit A1, a scanner unit A2, and a feeder unit A3. In a main body housing 1, the image forming unit A1 includes a sheet feeding portion 2, an image forming portion 3, a sheet discharge portion 4, and a data processing portion 5.

The sheet feeding portion 2 includes a plurality of cassette mechanisms 2*a*, 2*b*, and 2*c* configured to receive sheets of different sizes to be subjected to image formation, respectively, and sends out sheets having a size designated by a main body control portion (not shown) to a sheet feeding passage 6. The cassette mechanisms 2*a*, 2*b*, and 2*c* are removably placed in the sheet feeding portion 2, and each cassette mechanism includes a separating mechanism configured to separate sheets in the cassette mechanism into individual sheets and a sheet feeding mechanism configured to send out the sheets. On the sheet feeding passage 6, there are provided conveyance rollers configured to feed sheets, which are fed from the respective cassette mechanisms 2*a*, 2*b*, and 2*c*, to downstream, and a registration roller pair. The registration roller pair is provided at an end of the sheet feeding passage 6 and configured to correct skew feed of sheets.

A large capacity cassette 2*d* and a manual feed tray 2*e* are connected to the sheet feeding passage 6. The large capacity cassette 2*d* is an optional unit configured to receive sheets having a size which is consumed in large amounts. The manual feed tray 2*e* is configured to enable supply of special sheets, such as thick sheets, coated sheets, or film sheets, which are difficult to be separated and fed.

The image forming portion 3 is constructed by, for example, an electrostatic printing mechanism, and includes a photosensitive drum 9 to be rotated, and a light emitting unit 10 configured to emit an optical beam, a developing unit 11, and a cleaner (not shown), which are arranged at the periphery of the photosensitive drum 9. The image forming portion 3 having a monochromatic printing mechanism is illustrated in FIG. 1. A latent image is optically formed on the photosensitive drum 9 by the light emitting unit 10, and the developing unit 11 causes toner to adhere on the latent image.

A sheet is fed from the sheet feeding passage 6 to the image forming portion 3 at a timing of forming an image on the photosensitive drum 9, and the toner image is transferred onto the sheet by a transfer charger 12. The toner image is fixed on the sheet by fixing rollers 13 arranged on a sheet discharge passage 14. On the sheet discharge passage 14, there are arranged a sheet discharge roller 15 and a sheet discharge port 16 to convey the sheet having the image formed thereon to the sheet post-processing apparatus B described later.

The scanner unit A2 includes a platen 17 configured to place an original, a carriage 18 configured to reciprocate along the platen 17, a photoelectric converter 19, and a reduction optical system 20 configured to guide light, which is radiated from the carriage 18 and reflected from the original placed on the platen 17, to the photoelectric converter 19. The photoelectric converter 19 is configured to photoelectrically convert optical output from the reduction optical system 20 to image data and to output the image data to the image forming portion 3 as an electric signal.

Further, the scanner unit A2 includes a running platen 21 configured to read an image on an original fed from the feeder unit A3. The feeder unit A3 includes a feeding tray 22, a feeding passage 23 configured to guide the original fed from the feeding tray 22 to the running platen 21, and a discharge tray 24 configured to receive the original discharged after having passed on the running platen 21. The original fed from the feeding tray 22 is read by the carriage 18 and the reduction optical system 20 when passing on the running platen 21.

Figure 2:
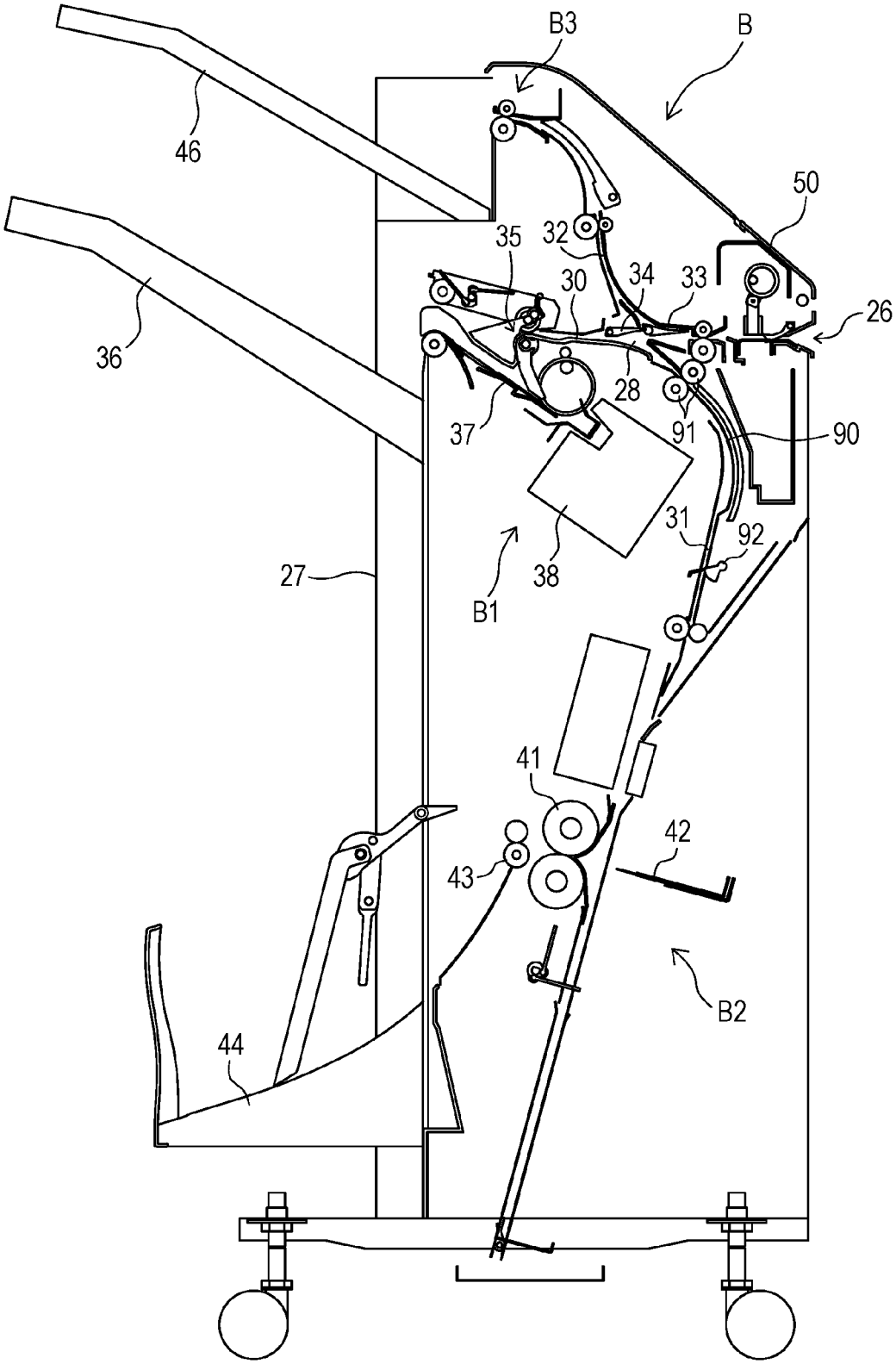
FIG. 2 is an explanatory view of the overall structure of a post-processing apparatus in the image forming system of FIG. 1.

FIG. 2 is an illustration of a configuration of the sheet post-processing apparatus B configured to perform post-processing on a sheet fed from the image forming apparatus A, on which an image is formed. The sheet post-processing apparatus B includes an apparatus housing 27 having a carry-in port 26 configured to introduce the sheet from the image forming apparatus A. The apparatus housing 27 is arranged at a position corresponding to the main body housing 1 of the image forming apparatus A so that the carry-in port 26 communicates with the sheet discharge port 16 of the image forming apparatus A.

The sheet post-processing apparatus B includes a sheet carry-in passage 28 configured to convey a sheet introduced from the carry-in port 26, a first sheet discharge path 30, a second sheet discharge path 31, and a third sheet discharge path 32, which branch out from the sheet carry-in passage 28, a first path-switching apparatus 33, and a second path-switching apparatus 34. Each of the first and second path-switching apparatuses 33 and 34 includes a flapper guide configured to change over a direction of conveyance of a sheet conveyed on the sheet carry-in passage 28.

The first path-switching apparatus 33 is configured to be switched by a driving device (not shown) into a mode of guiding a sheet from the carry-in port 26 to the third sheet discharge path 32 and a mode of guiding the sheet to a direction toward the first sheet discharge path 30 or the second sheet discharge path 31. The first sheet discharge path 30 and the second sheet discharge path 31 are arranged to communicate with each other so as to enable switch-back conveyance of reversing the conveyance direction of a sheet which has once been introduced to the first sheet discharge path 30 and introducing the sheet to the second sheet discharge path 31.

The second path-switching apparatus 34 is arranged at the downstream of the first path-switching apparatus 33. The second path-switching apparatus 34 is configured to be switched by a driving device (not shown) into a mode of introducing a sheet which has passed under the first path-switching apparatus 33 to the first sheet discharge path 30 and a switch-back conveyance mode of causing a sheet which has once been introduced to the first sheet discharge path 30 to be further introduced to the second sheet discharge path 31.

The sheet post-processing apparatus B includes a first processing portion B1, a second processing portion B2, and a third processing portion B3, which perform different post-processing schemes, respectively. Further, a punching unit 50 configured to form a punch hole in a fed sheet is arranged on the sheet carry-in passage 28.

Figure 12:
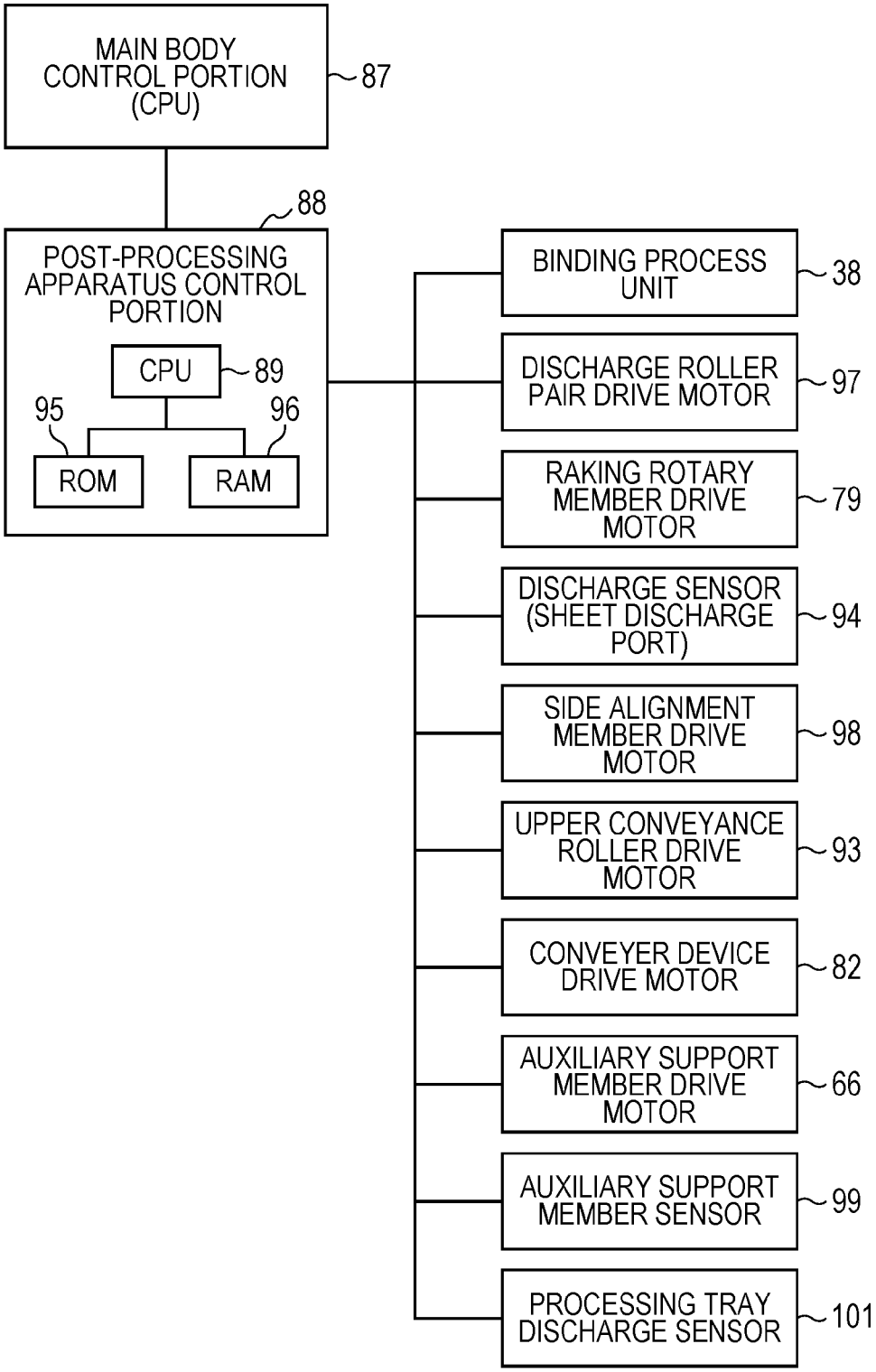
FIG. 12 is an explanatory view of the control structure in the sheet conveying apparatus according to the first embodiment of the present invention.

The first processing portion B1 is a binding process portion configured to stack, align, and bind a plurality of sheets conveyed from a sheet discharge port 35 at a downstream end of the first sheet discharge path 30, and to discharge the sheets onto a stacking tray (placement portion) 36 arranged outside the apparatus housing 27. As described later, the first processing portion B1 includes a sheet conveying apparatus 37 according to the embodiment configured to convey a sheet or a bundle of sheets, and a binding process unit 38 configured to bind the bundle of sheets. A discharge roller pair 39 configured to discharge sheets through the sheet discharge port 35 is arranged at the downstream end of the first sheet discharge path 30. The discharge roller pair 39 is rotated by a discharge roller pair drive motor 97 (FIG. 12).

The second processing portion B2 is configured to bundle a plurality of sheets switchback-conveyed from the second sheet discharge path 31 to form a bundle of sheets, bind the bundle of sheets at a central portion, and then fold the bundle of sheets. In folding, the bundle of sheets is arranged so that its folding position is located at a nip portion of a pair of folding rolls 41 brought into pressure contact with each other. Then, a folding blade 42 is inserted from an opposite side, and the pair of folding rolls 41 is rotated to fold the bundle of sheets. The folded bundle of sheets is discharged by discharge rollers to a stacking tray 44 arranged outside the apparatus housing 27.

The third processing portion B3 is configured to perform jog-sorting to sort sheets conveyed from the third sheet discharge path 32 into a group in which sheets are stacked with a predetermined amount of offset in a direction perpendicular to a direction of conveyance, and a group in which sheets are stacked without offset. The sheets after the jog-sorting are discharged to a stacking tray 46 arranged outside the apparatus housing 27, and offset sheet bundles and sheet bundles having no offset are stacked on top of each other.

Figure 3:
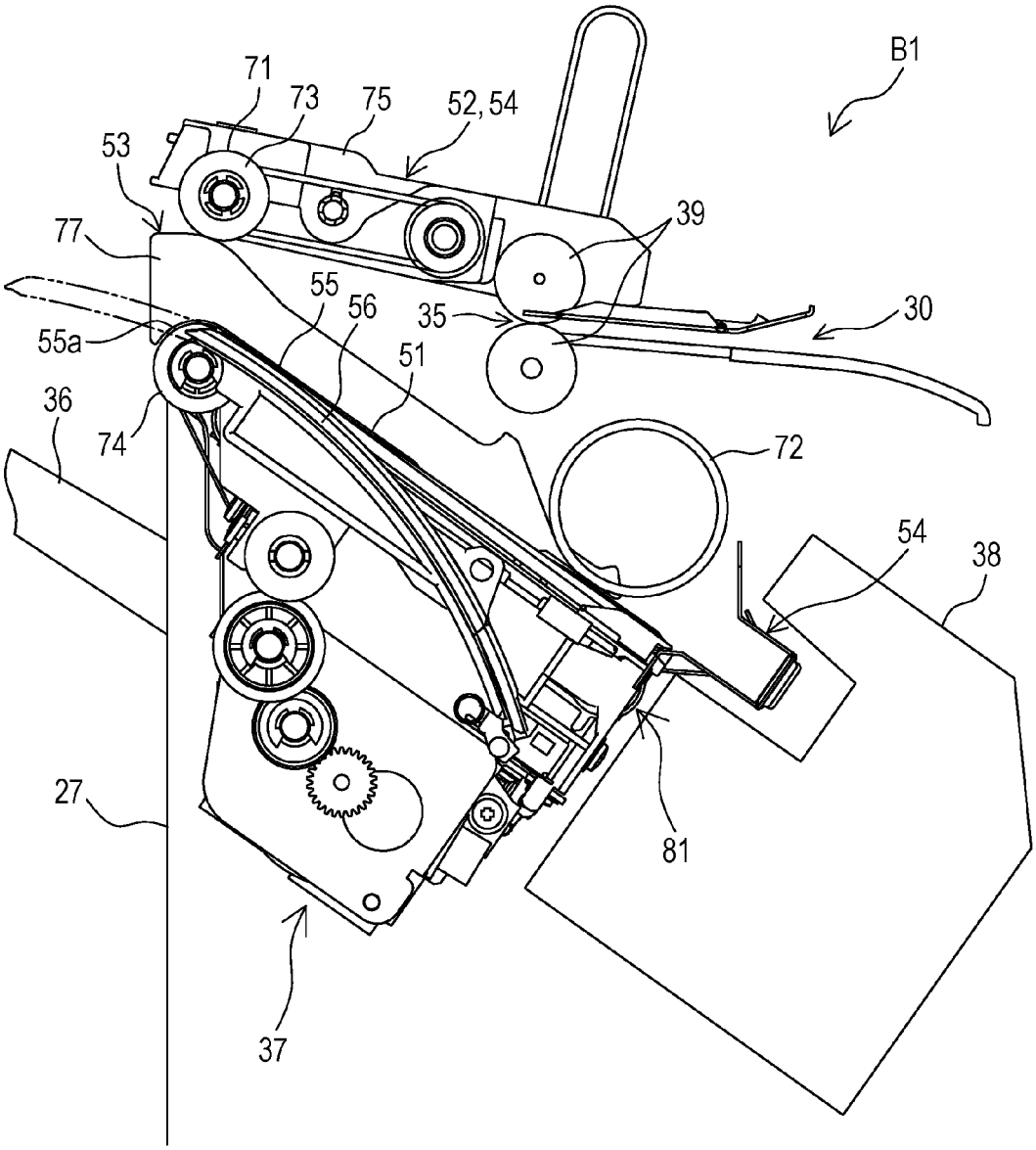
FIG. 3 is a side cross-sectional view of a vicinity of a binding process portion of the post-processing apparatus in FIG. 2.

The overall structure of the first processing portion B1 according to the first embodiment is schematically illustrated in FIG. 3. As described above, the first processing portion B1 includes the sheet conveying apparatus 37 configured to stack, align, and bind sheets from the sheet discharge port 35, and then discharge the sheets onto the stacking tray 36, and the binding process unit 38 configured to bind the bundle of sheets stacked and aligned by the sheet conveying apparatus 37. The binding process unit 38 illustrated in FIG. 3 is a stapler apparatus configured to drive a staple into the bundle of sheets to bind the bundle of sheets. A staple-less binding apparatus configured to bind a bundle of sheets without a staple may also be used as the binding process unit 38 instead of the stapler apparatus.

The sheet conveying apparatus 37 includes a processing tray 51 (support portion) arranged on a downstream side of the sheet discharge port 35 and spaced downwardly by a predetermined distance from the sheet discharge port 35. The sheet conveying apparatus 37 includes a sheet carry-in mechanism 52 configured to convey a sheet to be subjected to binding, which is discharged from the sheet discharge port 35 to the processing tray 51, to a back side of the processing tray 51, that is, to an opposite side to a direction of carry-out to the stacking tray 36, a sheet alignment mechanism 53 configured to stack a plurality of sheets on the processing tray 51 in a bundle form to position the sheets, and a sheet carry-out mechanism 54 configured to convey the bound sheets to the stacking tray (placement portion) 36.

Figure 4:
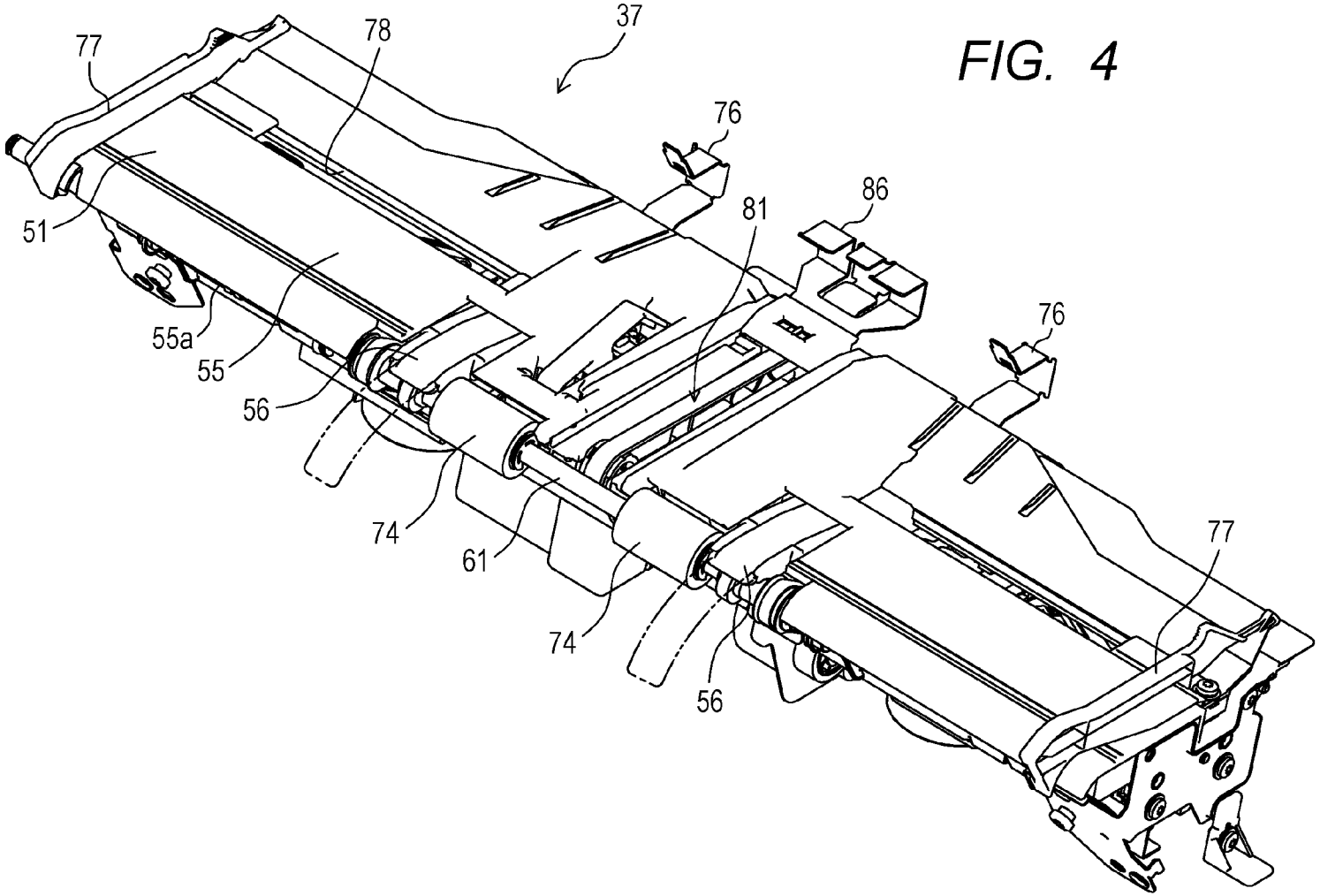
FIG. 4 is an overall perspective view of a sheet conveying apparatus according to a first embodiment of the present invention.

As illustrated in FIG. 4, the processing tray 51 has on its upper surface a substantially flat sheet support surface 55 configured to at least partially support a sheet along its carry-out direction. The sheet support surface 55 is inclined downward with a relatively large angle of about 40° from the downstream side toward an upstream side in the carry-out direction.

The processing tray 51 includes a pair of auxiliary support members (restriction members) 56 on the downstream side from a downstream end 55*a* of the sheet support surface 55. The auxiliary support members 56 are arranged on right and left and movable in and out toward above the stacking tray 36. Each of the auxiliary support members 56 is formed of an elongated tabular member and has an upper surface upwardly protruding and gently curved along the carry-out direction. Each of the auxiliary support members 56 is mounted so as to be movable in the carry-out direction and a direction opposite to the carry-out direction by a guide 57 fixed immediately below the processing tray 51.

Figure 5:
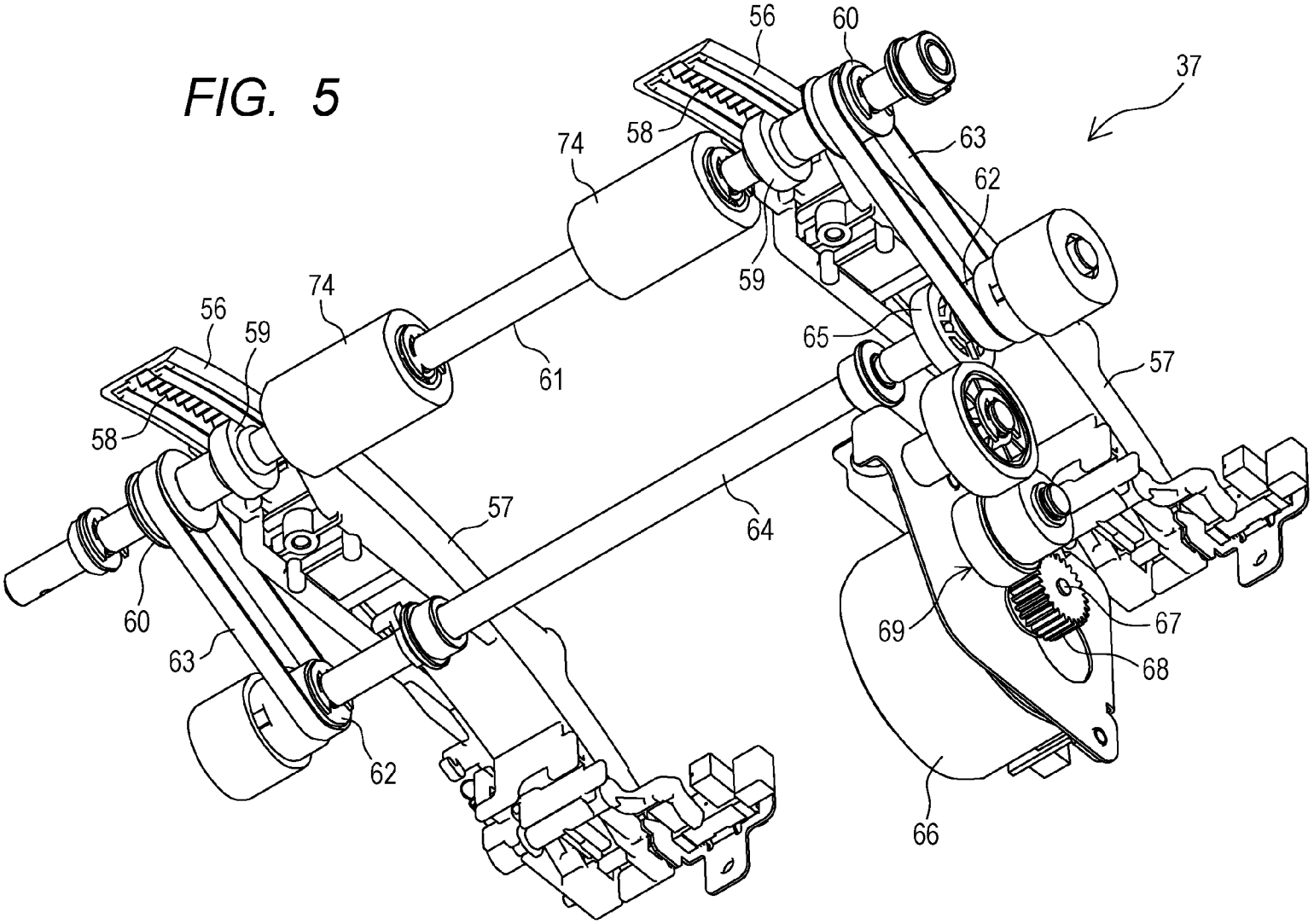
FIG. 5 is a perspective view of a sheet support mechanism of the sheet conveying apparatus in FIG. 4 when viewed from below.

As illustrated in FIG. 5, a rack 58 is formed on a lower surface of each auxiliary support member 56 along the carry-out direction. A drive pinion 59 rotatably mounted on a horizontal support rod 61 extending immediately below the processing tray 51 in a direction perpendicular to the carry-out direction, that is, a width direction, is meshed with the rack 58 of each auxiliary support member 56. A driven pulley 60 is rotatably mounted on the support rod 61 so as to be adjacent to each drive pinion 59. Each drive pinion 59 and its adjacent driven pulley 60 are connected to each other so as to rotate together.

The driven pulley 60 is coupled, in a power transmittable manner through a transmission belt 63, to a drive pulley 62 pivotally supported on a rotating rod 64 located on a lower side in parallel to the support rod 61 so that the driven pulley 60 and the drive pulley 62 rotate together. The rotating rod 64 includes a driven gear 65, which is adjacent to one drive pulley 62 and is pivotally supported on the rotating rod 64 so as to rotate together with the rotating rod 64. The driven gear 65 is coupled to a rotary shaft 67 of an auxiliary support member drive motor 66 in a power transmittable manner through a gear train 69 including a drive gear 68 mounted on a distal end of the rotary shaft 67.

This allows both the auxiliary support members 56 to be moved back and forth along the carry-out direction through rotation of the auxiliary support member drive motor (restriction member drive unit) 66 in forward and reverse directions. As indicated by a solid line in FIG. 4, a distal end of the auxiliary support member 56 is usually retracted slightly from the downstream end 55*a* of the sheet support surface 55 and is located at a retracted position within a plane of the sheet support surface 55. Rotation of the drive motor 66 allows the distal end of the auxiliary support member 56 to be extended to a position above the stacking tray 36 located downstream from the downstream end 55*a* in the direction of conveyance, as indicated by an imaginary line in FIG. 4. Drive of the drive motor 66 is controlled by a post-processing apparatus control portion arranged in the sheet post-processing apparatus B, as described later.

When the auxiliary support member 56 is extended from the processing tray 51, its upper surface forms an auxiliary sheet support surface substantially continuing from the sheet support surface 55 toward above the stacking tray 36. An upstream-side portion along the carry-out direction of a sheet discharged from the sheet discharge port 35 to the processing tray 51 is supported on the sheet support surface 55 and a downstream-side portion thereof is supported on the auxiliary sheet support surface of the auxiliary support member 56.

In a state in which the auxiliary support member 56 is extended to the position above the stacking tray 36, the auxiliary sheet support surface is curved so that the upper surface of the auxiliary support member 56 is upwardly convex. Therefore, an inclination from the downstream end of the sheet support surface 55 to a downstream end of the auxiliary support member 56 is gradually made gentle. The upper surface of the auxiliary support member 56 extending from the processing tray 51 has such a length in the carry-out direction and a curved shape that the auxiliary sheet support surface can be made substantially horizontal on its distal end side and be further inclined downward toward the downstream side.

The downstream-side portion of the sheet is supported on the auxiliary sheet support surface, which can prevent the sheet from slipping down on an upstream side of the processing tray 51 having the relatively sharply inclined sheet support surface 55. The auxiliary support member 56 secures the length in the carry-out direction sufficient to support the sheet, which allows dimensions of the processing tray 51 in the carry-out direction to be reduced. Therefore, the sheet conveying apparatus 37 and the sheet post-processing apparatus B can be reduced in size in the carry-out direction.

The sheet carry-in mechanism 52 includes a conveyance roller apparatus (conveyance portion) 71 also serving as a sheet bundle carry-out mechanism 54 as described later, and a raking rotary member 72. The conveyance roller apparatus 71 includes two roller pairs arranged on right and left in the width direction. Each roller pair has an upper conveyance roller 73 and a lower conveyance roller 74 with respect to the processing tray 51 located therebetween. The upper conveyance roller 73 is rotatably supported at a distal end of a raising and lowering bracket 75 swingably supported above the processing tray 51, and the lower conveyance roller 74 is rotatably mounted on the support rod 61 on the lower side of the processing tray. The upper conveyance roller 73 is rotated by an upper conveyance roller drive motor (roller drive device) 93 (FIG. 12). The raking rotary member 72 is rotated by a raking rotary member drive motor 79 (FIG. 12).

When the sheet is discharged from the sheet discharge port 35 to the processing tray 51, the raising and lowering bracket 75 is turned downward to bring the upper conveyance roller 73 into contact with an upper surface of the sheet on the processing tray 51. Next, the upper conveyance roller 73 is driven to rotate in a counterclockwise direction in FIG. 3 and the lower conveyance roller 74 is driven to rotate in a clockwise direction in FIG. 3. This allows the sheet to be conveyed on the processing tray 51 in a carry-in direction, that is, in a direction opposite to the carry-out direction.

The raking rotary member 72 is formed of a ring-shaped or short cylindrical belt member rotatably arranged above the processing tray 51 on the upstream side in the carry-out direction. The belt member rotates in the counterclockwise direction in FIG. 3 while being in contact with and pressing the upper surface of the sheet being conveyed on the processing tray 51. This allows the sheet to be fed until its leading edge comes into contact with latching members 76 provided at an upstream end of the processing tray 51 in the carry-out direction while protecting the sheet being conveyed from curling and skewing that may occur. Each latching member 76 is formed of, for example, a channel-like member having a U-shaped cross-section illustrated in FIG. 4.

The sheet alignment mechanism 53 includes a sheet edge restricting portion and a side alignment mechanism. The sheet edge restricting portion has the above-mentioned pair of latching members 76 arranged on right and left. The latching members 76 restrict, in the carry-in (or carry-out) direction, the position of the sheet having entered from the sheet discharge port 35 on the processing tray 51 at the leading edge of the sheet in the carry-in direction (or at a trailing edge of the sheet in the carry-out direction).

The side alignment mechanism moves a sheet or a bundle of sheets on the processing tray 51 in the width direction to restrict and/or align the positions in the width direction at side edges. As illustrated in FIG. 4, the side alignment mechanism includes a pair of side alignment members 77 arranged on right and left with respect to a center of the processing tray 51 in its width direction. The side alignment members 77 are each formed of a tabular member protruding vertically upward from the sheet support surface 55 of the processing tray 51, with their inner surfaces facing each other. The inner surface of each side alignment member 77 is engaged with the adjacent side edge of the sheet in the width direction on the processing tray 51 to restrict the position of the sheet in its width direction.

Each side alignment member 77 is integrally connected to a movable support portion (not shown) provided on a back side of the processing tray 51 through a linear slit 78 in the width direction, which is formed in the processing tray 51. Each of the movable support portions is driven by an individual drive motor 98 through intermediation of, for example, a rack-and-pinion mechanism to be moved from side to side in the width direction so that the respective side alignment members 77 can be moved independently of each other in directions of becoming closer to or away from each other to be stopped at desired positions in the width direction.

Figure 6:
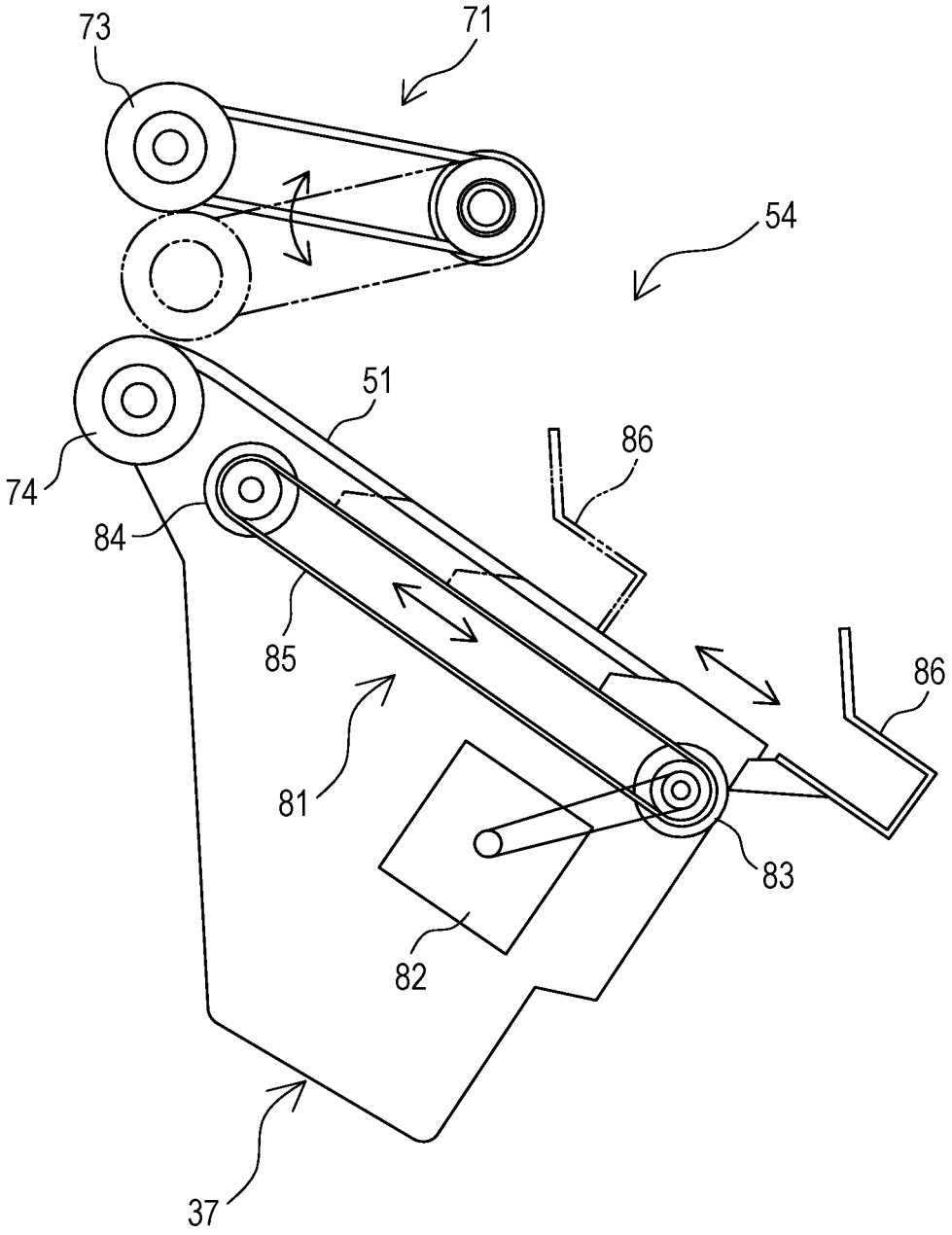
FIG. 6 is a schematic structural view of a sheet conveying mechanism.

As illustrated in FIG. 6, the sheet carry-out mechanism 54 includes a conveyer device 81 and the above-mentioned conveyance roller apparatus 71. The conveyer device 81 includes a conveyer belt 85 stretched around a drive pulley 83 driven by a drive motor 82 and a driven pulley 84, and circumferentially moving in both directions along the carry-out direction of the sheet. A sheet push-out member 86 moving along the sheet support surface 55 of the processing tray 51 is fixed to the conveyer belt 85.

The sheet push-out member 86 is arranged to be movable in both directions between an initial position near the upstream end of the processing tray 51 in the carry-out direction and a maximum push-out position set substantially midway between the drive pulley 83 and the driven pulley 84. The sheet push-out member 86 is formed of, for example, a channel-like member having a U-shaped cross-section illustrated in FIG. 4, and is configured to feed out the sheet in the carry-out direction so that the trailing edge of the sheet or the upstream edge of the sheet in the carry-out direction on the sheet support surface 55 is pushed out. Further, the sheet push-out member 86 serves as a part of the sheet edge restricting portion to restrict a trailing edge position of the sheet at least at a position to which the sheet push-out member 86 is moved in the carry-out direction from the initial position.

The conveyance roller apparatus 71 is arranged so that the upper conveyance roller 73 and the lower conveyance roller 74 in each pair nip the sheet from above and below in a vicinity of a downstream end of the processing tray 51 in the carry-out direction in a conveyable manner. As illustrated in FIG. 4, the roller pairs 73 and 74 on right and left are arranged so as to be symmetric with respect to the center of the processing tray 51 in the width direction.

The respective lower conveyance rollers 74 are arranged so that their adjacent auxiliary support members 56 are located outside the lower conveyance rollers 74 in the width direction. Further, a range of movement of each auxiliary support member 56 from the retracted position to the extended position is set so that the auxiliary support member 56 overlaps with an outer periphery of the corresponding lower conveyance roller 74 as viewed from the width direction as illustrated in FIG. 3. In other words, each auxiliary support member 56 is arranged so that the upper surface of the auxiliary support member 56 and the outer peripheral surface of the lower conveyance roller 74 partially overlap each other in the range or path in which the distal end or the downstream end in the carry-out direction of the auxiliary support member 56 extends from the retracted position to the downstream side. This allows the distal end of the auxiliary support member 56 to be extended toward the lower surface of the sheet located above the stacking tray 36 from the portion between the upper conveyance roller 73 and the lower conveyance roller 74.

A series of operations including feeding and stacking a plurality of sheets to and on the processing tray 51, binding the sheets, and then discharging the bound sheets to the stacking tray 36 in the first processing portion B1 of the sheet post-processing apparatus B according to the embodiment will be described below. The series of operations can be controlled by a post-processing apparatus control portion 88 (FIG. 12) arranged in the sheet post-processing apparatus B, as described later.

Figure 10A:
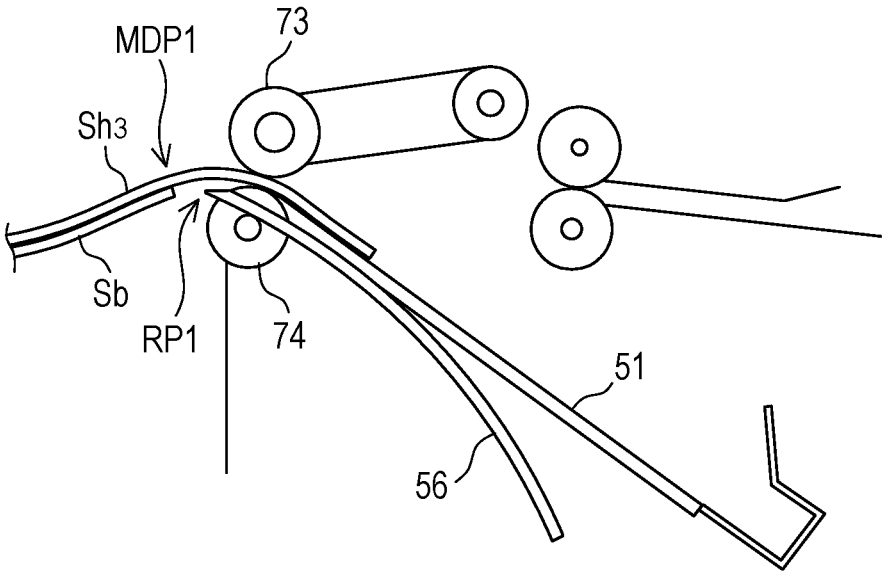
FIG. 10A and FIG. 10B are schematic explanatory views for illustrating a first mode in which a preceding sheet is caused to fall on a stacking tray.
Figure 10B:
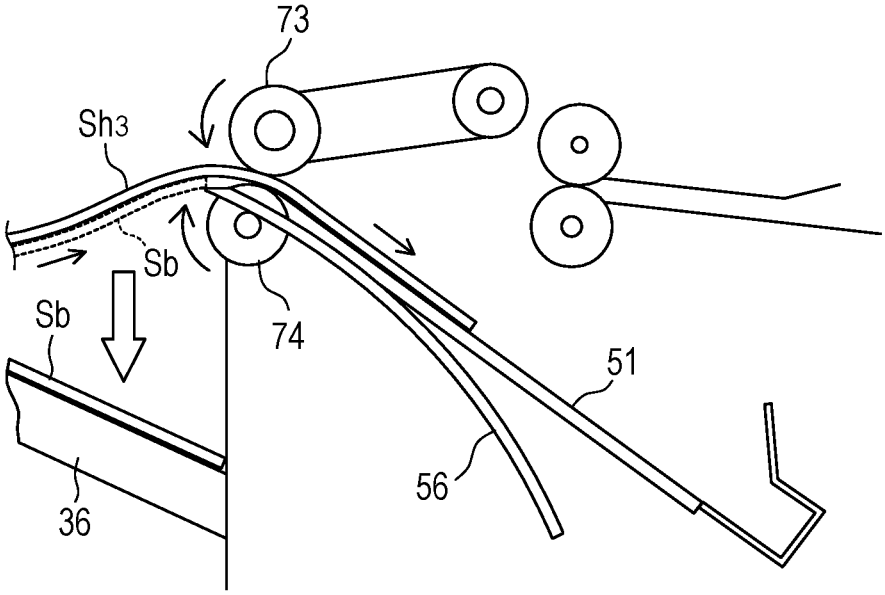
Figure 11A:
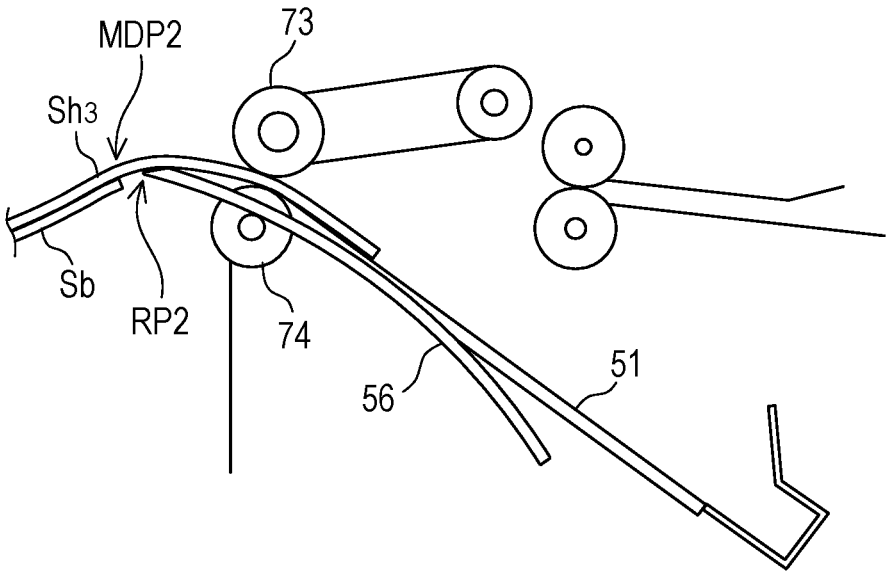
FIG. 11A and FIG. 11B are schematic explanatory views for illustrating a second mode in which the preceding sheet is caused to fall on the stacking tray.
Figure 11B:
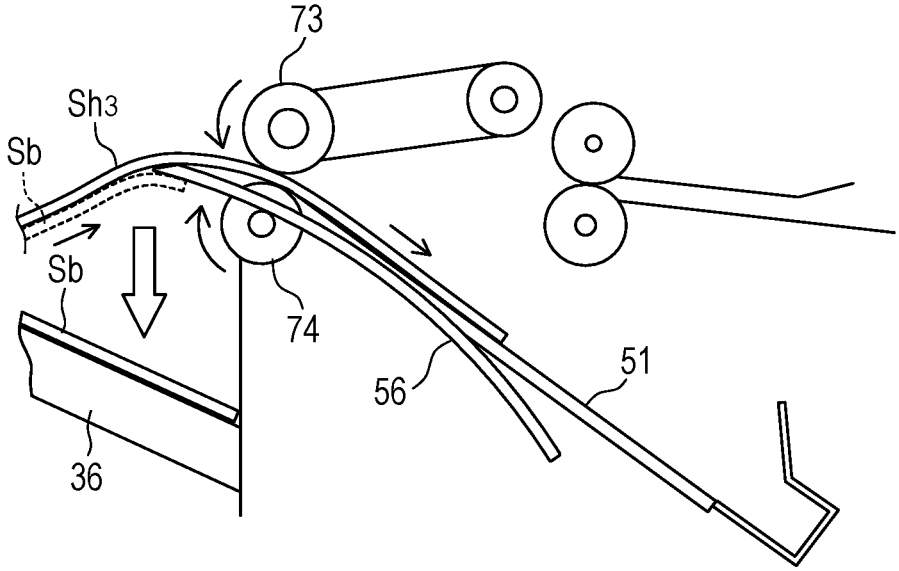

FIG. 7A to FIG. 7D are illustrations of a process of conveying and stacking a plurality of sheets into and on the processing tray 51. FIG. 8A to FIG. 8E are illustrations of a process of buffering a succeeding sheet. FIG. 9A to FIG. 9E are illustrations of a process of overlaying a succeeding sheet on a preceding sheet on the processing tray 51 and simultaneously conveying the sheets. FIG. 10A and FIG. 10B are illustrations of a first mode in which a preceding sheet is separated from its succeeding sheet. FIG. 11A and FIG. 11B are illustrations of a second mode in which the preceding sheet is separated from its succeeding sheet.

The control structure of an image forming system including the sheet conveying apparatus 37 according to the first embodiment is illustrated in FIG. 12, and the image forming system includes a main body control portion 87 of the image forming apparatus A and the post-processing apparatus control portion 88 of the sheet post-processing apparatus B, which is connected to the main body control portion 87. The main body control portion 87 provides, to the post-processing apparatus control portion 88, information on feeding of sheets from the image forming apparatus A to the sheet post-processing apparatus B. The post-processing apparatus control portion 88 includes a CPU 89, and a ROM 95 and a RAM 96 connected to the CPU 89, and executes post-processing in the first processing portion B1 based on a control program stored in the ROM 95 and control data stored in the RAM 96. Therefore, all of the above-mentioned drive motors and sensors are connected to the CPU 89 of the post-processing apparatus control portion 88 and the CPU 89 controls drive of the respective drive motors.

Figure 7A:
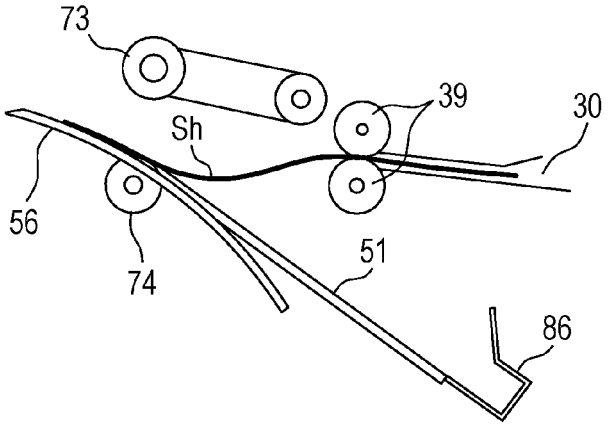
FIG. 7A, FIG. 7B, FIG. 7C, and FIG. 7D are schematic explanatory views for illustrating a process of conveying and stacking a plurality of sheets into and on a processing tray.
Figure 7B:
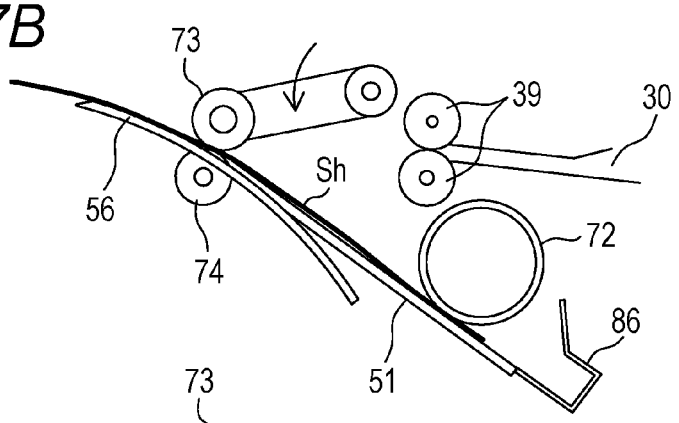

First, as illustrated in FIG. 7A, the auxiliary support member 56 is extended from the retracted position to the position above the stacking tray 36 to discharge a sheet Sh from the sheet discharge port 35 onto the processing tray 51. When a discharge sensor 94 arranged in a vicinity of the first sheet discharge path 30 and the sheet discharge port 35 detects a trailing edge of the sheet Sh, discharge of the sheet Sh onto the processing tray 51 is detected to operate the sheet carry-in mechanism 52. As illustrated in FIG. 7B, the raising and lowering bracket 75 is turned downward to bring the upper conveyance roller 73 into contact with the upper surface of the sheet on the processing tray 51 and rotate the upper conveyance roller 73 in the counterclockwise direction in FIG. 7B, and the raking rotary member 72 is also rotated in the counterclockwise direction in FIG. 7B to convey the sheet until the leading edge of the sheet comes into contact with the latching member 76 in the carry-in direction.

Figure 7C:
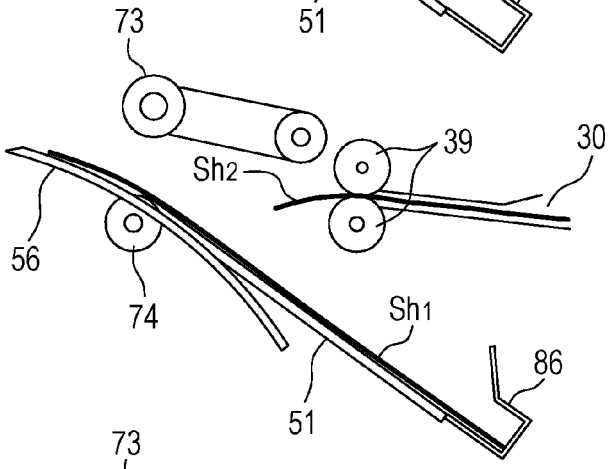
Figure 7D:
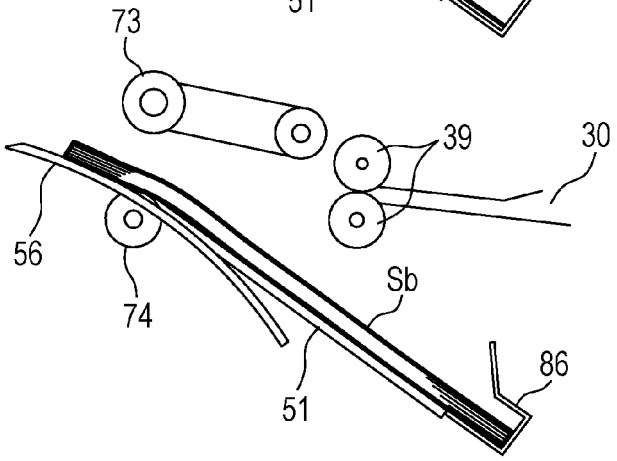

A succeeding sheet $Sh_2$ is discharged onto the processing tray 51 and conveyed by the sheet carry-in mechanism 52 to be stacked on the preceding sheet $Sh_1$ in the same manner as above, as illustrated in FIG. 7C. The succeeding sheet $Sh_2$ is aligned with the preceding sheet $Sh_1$ by the sheet alignment mechanism 53 in positions in the carry-in direction and the width direction. As illustrated in FIG. 7D, a predetermined number of sheets are thus stacked on the processing tray 51 as a sheet bundle. The sheet bundle Sb is bound on the processing tray 51 by the binding process unit 38.

While the sheet bundle Sb is bound, a succeeding sheet $Sh_3$ to be fed from the image forming apparatus A is conveyed from the sheet carry-in passage 28 to the first sheet discharge path 30 in a state in which the first and second path-switching apparatuses 33 and 34 are opened, but is buffered, that is, temporarily retained in a buffer path 90 without being discharged from the sheet discharge port 35. The buffer path 90 according to the embodiment is formed of an upstream-side portion of the second sheet discharge path 31 communicating with the upstream side of the first sheet discharge path 30.

Figure 8A:
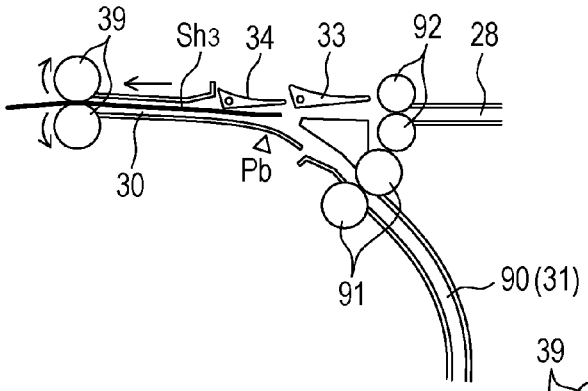
FIG. 8A, FIG. 8B, FIG. 8C, FIG. 8D, and FIG. 8E are schematic explanatory views for illustrating a process of buffering a succeeding seat.

As illustrated in FIG. 8A, the succeeding sheet $Sh_3$ is then conveyed to the downstream side by the discharge roller pair 39 along the first sheet discharge path 30 until its trailing edge, that is, its upstream edge passes under the second path-switching apparatus 34 to reach a predetermined switchback position Pb. In this step, the leading edge portion on the downstream side of the sheet $Sh_3$ reaches above the processing tray 51 from the sheet discharge port 35 but the sheet $Sh_3$ is not completely discharged therefrom.

Figure 8B:
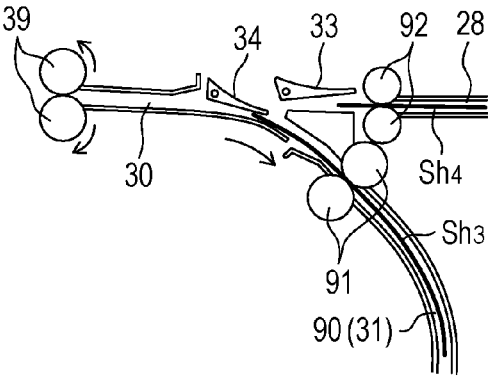

When the trailing edge of the succeeding sheet $Sh_3$ reaches the switchback position Pb, as illustrated in FIG. 8B, the second path-switching apparatus 34 is closed and the discharge roller pair 39 is reversed so that the succeeding sheet $Sh_3$ is switchback-conveyed and fed into the buffer path 90 (second sheet discharge path 31). The sheet $Sh_3$ is held at a predetermined buffer position in the buffer path 90 with its downstream edge positioned in a vicinity of an inlet of the first sheet discharge path 30 and nipped by a conveyance roller pair 91.

Figure 8C:
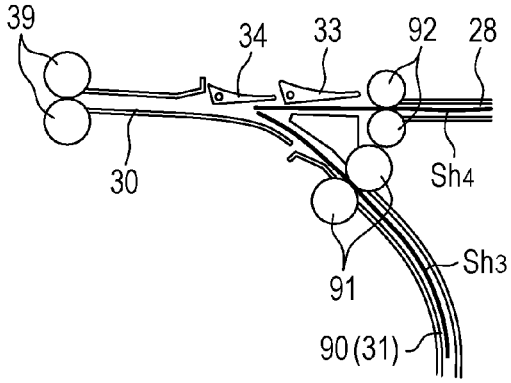

When a downstream-side leading edge of a next succeeding sheet $Sh_4$ having been conveyed along the sheet carry-in passage 28 enters the first sheet discharge path 30 and reaches a position matching with the downstream edge of the succeeding sheet $Sh_3$ preceding the sheet $Sh_4$ and located at the buffer position as illustrated in FIG. 8C, the conveyance roller pair 91 is rotated to convey the succeeding sheet $Sh_3$ preceding the sheet $Sh_4$ to the first sheet discharge path 30 from the buffer path 90. The conveying speed of the conveyance roller pair 91 is the same as that of a conveyance roller pair 92 of the sheet carry-in passage 28. Therefore, the succeeding sheet $Sh_3$ preceding the sheet $Sh_4$ and the next succeeding sheet $Sh_4$ are conveyed toward the discharge roller pair 39 in an overlaid state inside the first sheet discharge path 30.

Figure 8D:
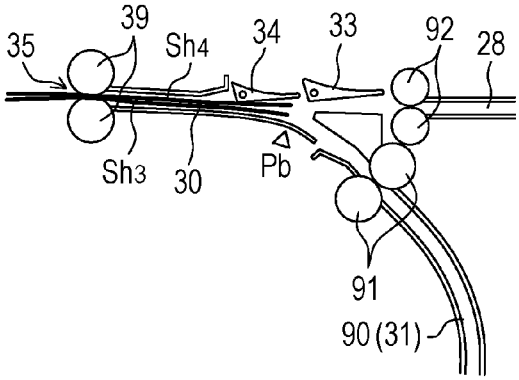

The discharge roller pair 39 conveys the succeeding sheets $Sh_3$ and $Sh_4$ in the carry-out direction to partially discharge the succeeding sheets $Sh_3$ and $Sh_4$ from the sheet discharge port 35. When the trailing edge positions of the succeeding sheets $Sh_3$ and $Sh_4$ reach the switchback position Pb in the first sheet discharge path 30, as illustrated in FIG. 8D, the second path-switching apparatus 34 is closed and the discharge roller pair 39 is reversed so that the sheets $Sh_3$ and $Sh_4$ are switchback-conveyed and fed into the buffer path 90. The succeeding sheets $Sh_3$ and $Sh_4$ conveyed to the buffer path 90 are nipped by the conveyance roller pair 91 and are conveyed to and held at the predetermined buffer position.

Figure 8E:
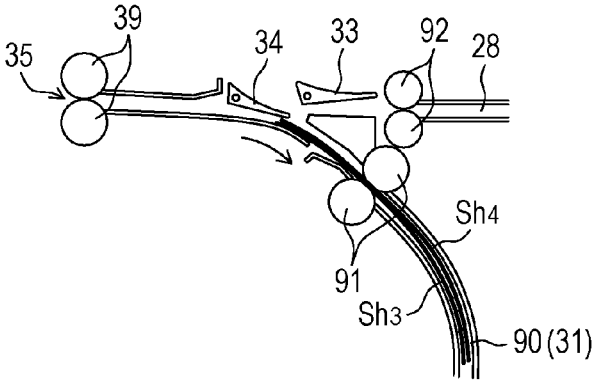

The series of steps is repeated to allow a predetermined number of succeeding sheets $Sh_3$ and $Sh_4$ to remain in the buffer path 90, as illustrated in FIG. 8E. The number of sheets to remain can be set based on a period of time required to bind the sheet bundle Sb in the first processing portion B1 and a conveying speed of sheets fed from the image forming apparatus A, but does not exceed the number of sheets in a sheet bundle to be bound at a time.

The succeeding sheets $Sh_3$ and $Sh_4$ in the buffer path 90 are conveyed again to the first sheet discharge path 30 by the conveyance roller pair 91 at a timing synchronized with the end of binding of the sheet bundle Sb in the first processing portion B1. When the number of buffered sheets is the same as the number of sheets in a bundle to be bound at a time, the sheets are preferably discharged from the buffer path 90 to the processing tray 51 before a next succeeding sheet is fed to the first sheet discharge path 30 from the image forming apparatus A.

Figure 13:
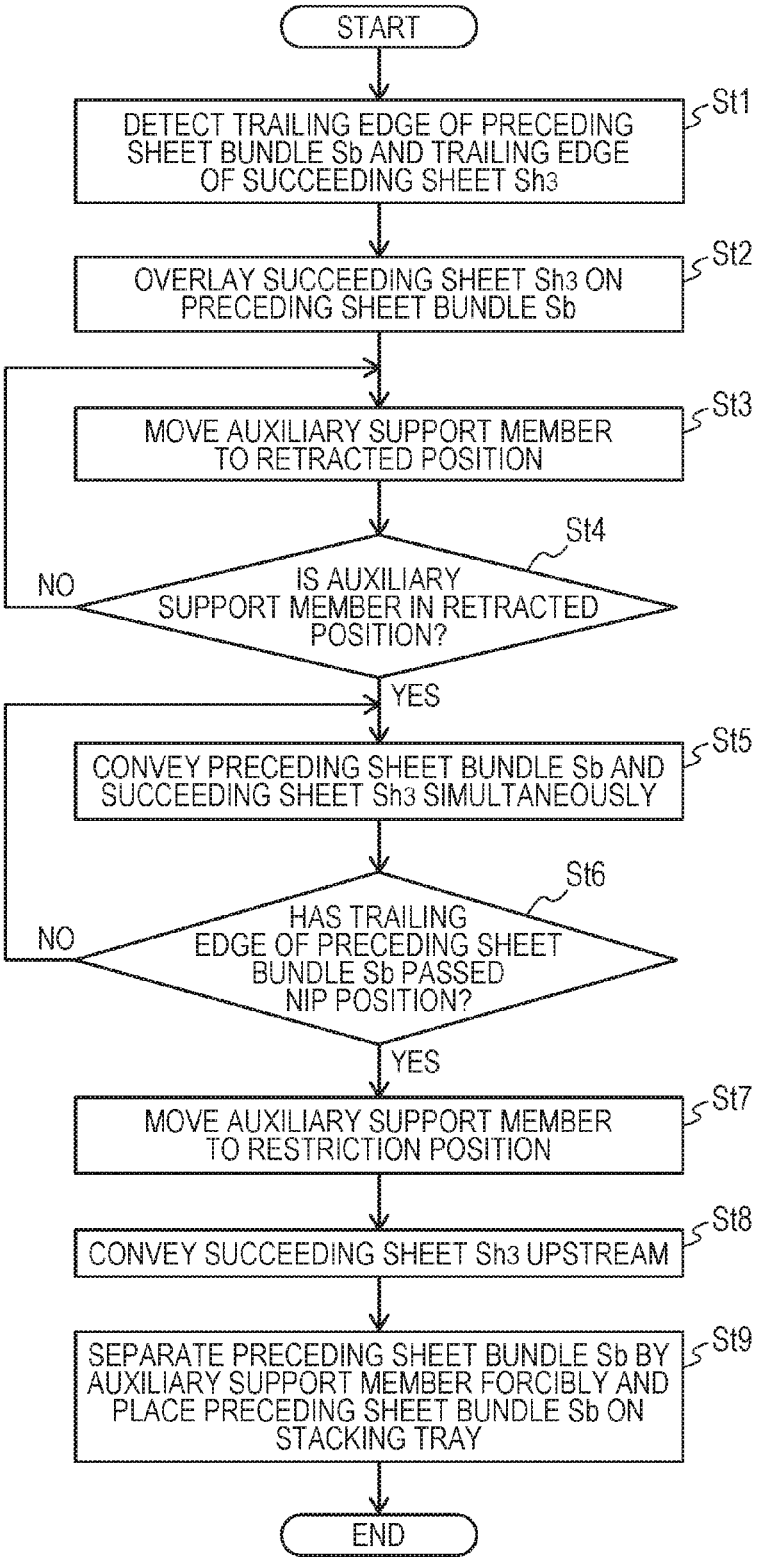
FIG. 13 is a flow chart of a sheet carry-out process.
Figure 14:
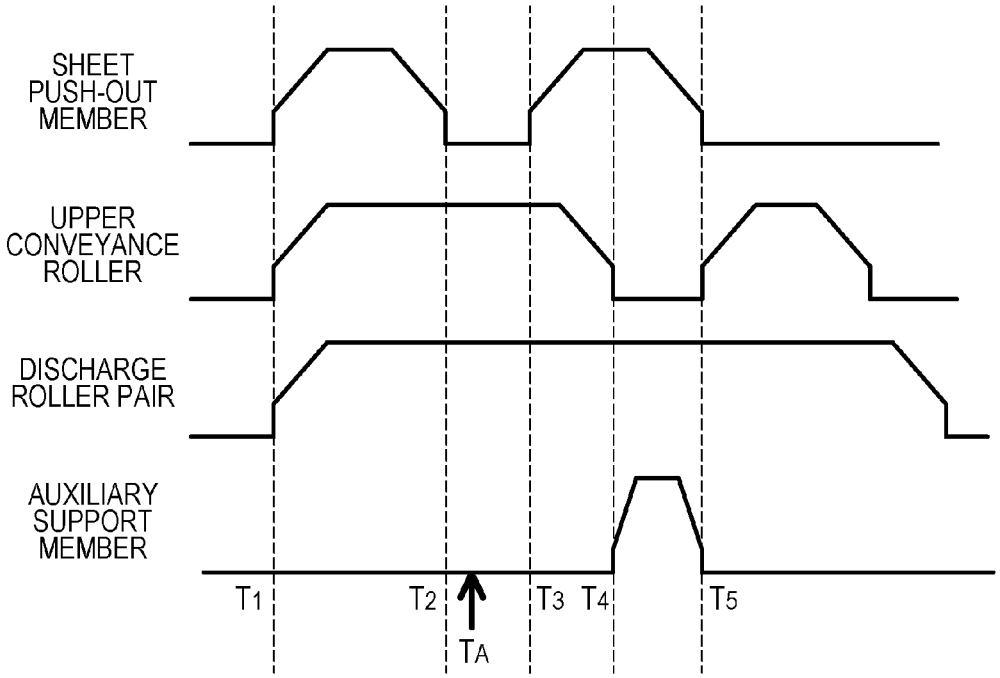
FIG. 14 is an operation sequence diagram of the sheet carry-out process.

Next, a step of discharging the sheet bundle Sb after the end of binding in the first processing portion B1 to the stacking tray 36 will be described. This discharge step is controlled by the post-processing apparatus control portion 88 of the sheet post-processing apparatus B in the same manner as in the above-mentioned respective steps. A control flow in the sheet discharge step performed by the post-processing apparatus control portion 88 is illustrated in FIG. 13. FIG. 14 is an explanatory diagram for illustrating operation timings of the sheet push-out member 86, the upper conveyance roller 73, and the discharge roller pair 39, and a horizontal axis and a vertical axis represent time and sheet conveying speed, respectively.

Figure 9A:
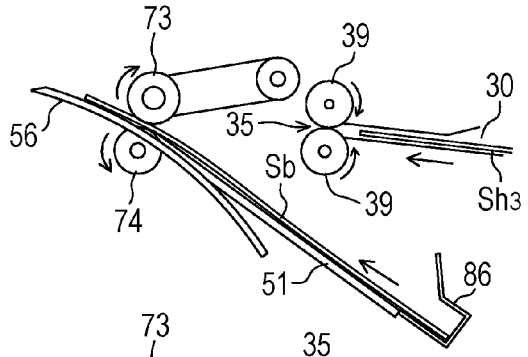
FIG. 9A, FIG. 9B, FIG. 9C, FIG. 9D, and FIG. 9E are schematic explanatory views for illustrating a process of overlaying a succeeding sheet on a preceding sheet and simultaneously conveying the sheets.
Figure 9B:
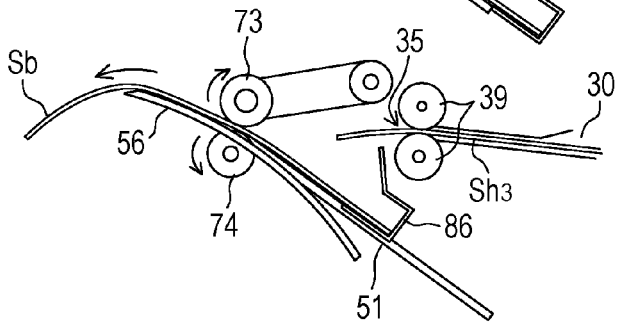

First, as illustrated in FIG. 9A, the upper conveyance roller 73 is moved downward to be brought into contact with an upper surface of the sheet bundle Sb so that the sheet bundle Sb is nipped between the upper conveyance roller 73 and the lower conveyance roller 74. Next, the upper conveyance roller 73 is driven to rotate in the clockwise direction in FIG. 9A and the lower conveyance roller 74 is driven to rotate in the counterclockwise direction in FIG. 9A. At the same time, the sheet push-out member 86 is driven to convey the sheet bundle Sb in the carry-out direction. Even after the sheet push-out member is stopped at the maximum push-out position as illustrated in FIG. 9B, the upper conveyance roller 73 is rotated to convey the sheet bundle Sb continuously at the same constant speed. In this step, the auxiliary support members 56 remain extended to the position above the stacking tray 36.

In synchronization with conveyance of the sheet bundle Sb, the succeeding sheet $Sh_3$ (also including the succeeding sheet $Sh_4$ described above in connection with FIG. 8E) is conveyed to the first sheet discharge path 30 from the buffer path 90. The discharge roller pair 39 starts to rotate simultaneously with the conveyance roller pairs 73 and 74, and the sheet push-out member 86 to discharge the succeeding sheet $Sh_3$ from the sheet discharge port 35 onto the processing tray 51. Then, the sheet push-out member 86 is returned to the initial position on the upstream end of the processing tray 51.

In the process of those operations, a trailing edge position of the sheet bundle Sb and a trailing edge position of the succeeding sheet $Sh_3$ are detected (Step St1). The trailing edge position of the sheet bundle Sb is detectable based on the position of the sheet push-out member 86 while the sheet bundle Sb is conveyed by the sheet push-out member 86. The trailing edge position of the succeeding sheet $Sh_3$ can be detected by the discharge sensor 94 provided in the first sheet discharge path 30, and discharge of the sheet $Sh_3$ from the sheet discharge port 35 can be thus confirmed.

Figure 9C:
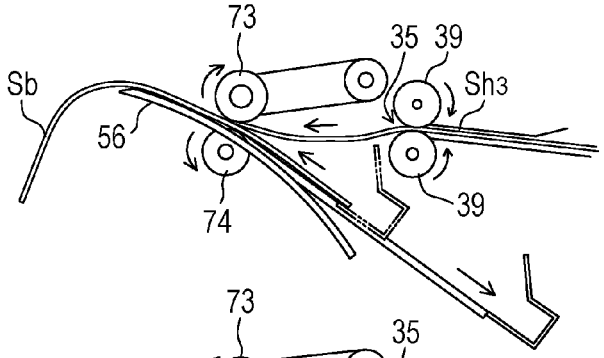

The discharged succeeding sheet $Sh_3$ is overlaid from its leading edge on an upper surface of the sheet bundle Sb being conveyed on the processing tray 51 (Step St2), and is sandwiched between the upper surface of the sheet bundle Sb and the upper conveyance roller 73, as illustrated in FIG. 9C. The succeeding sheet $Sh_3$ is conveyed together with the sheet bundle Sb in the carry-out direction in a state in which the succeeding sheet $Sh_3$ is thus overlaid on the preceding sheet bundle Sb.

Figure 9D:
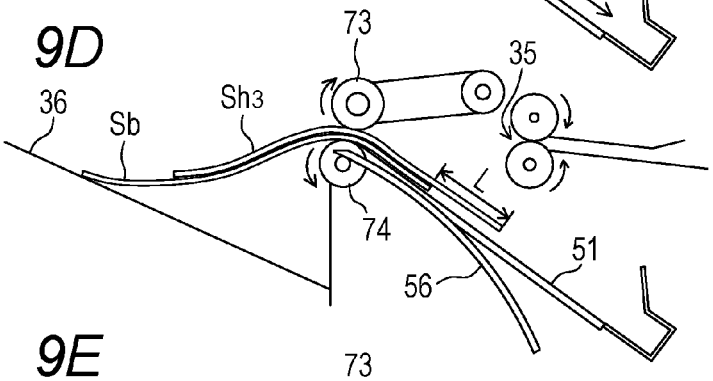

When the succeeding sheet $Sh_3$ is completely discharged, as illustrated in FIG. 9D, the auxiliary support member 56 is moved from the extended position above the stacking tray 36 to the retracted position (Step St3). In this step, a displacement occurs by an amount corresponding to a length L in the succeeding sheet $Sh_3$ on the upstream side in the carry-out direction with respect to the sheet bundle Sb. The displacement amount L is set to have an approximately predetermined value or to fall within a predetermined value range. The displacement amount L can be adjusted based on, for example, a timing at which the succeeding sheet $Sh_3$ is discharged from the sheet discharge port 35.

Figure 9E:
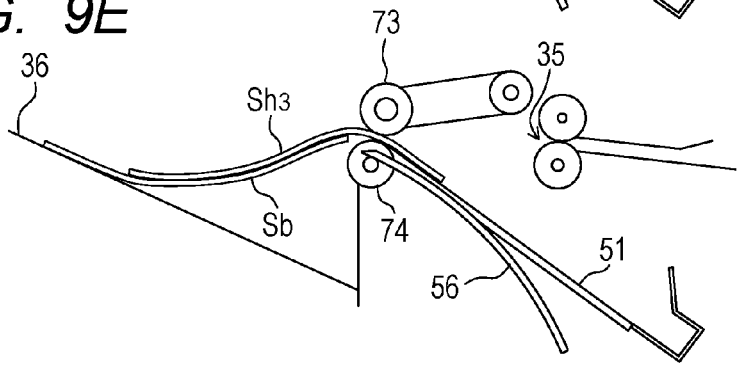

When it is confirmed with an auxiliary support member sensor 99 that the auxiliary support member 56 has returned to the retracted position (Step St4), the upper conveyance roller 73 and the lower conveyance roller 74 are rotated in the clockwise direction and the counterclockwise direction in FIG. 9E, respectively, and the sheet bundle Sb and the sheet $Sh_3$ are conveyed to a predetermined maximum downstream position on the downstream side, as illustrated in FIG. 9E (Step St5). The maximum downstream position is a position where a trailing edge of the preceding sheet bundle Sb passes at least a nip position for sheet nipping between the upper conveyance roller 73 and the lower conveyance roller 74 and the succeeding sheet $Sh_3$ (and the succeeding sheet $Sh_4$) is nipped between the upper conveyance roller 73 and the lower conveyance roller 74.

It is confirmed that a trailing edge of the preceding sheet bundle Sb has passed the nip position with the use of a processing tray discharge sensor 101 provided in a vicinity of the lower conveyance roller 74 or based on an outer circumferential length of each of roller surfaces of the upper conveyance roller 73 and the lower conveyance roller 74 configured to nip the conveyed sheet therebetween and the number of roller rotations (Step St6). In a case where the sheet bundle Sb is not attracted to a lower surface of the succeeding sheet $Sh_3$ and is freely separable from the lower surface when its trailing edge has passed the nip position, the sheet bundle Sb naturally falls under its own weight to be placed on the stacking tray 36 located below.

If not, the sheet bundle Sb is not separated from the lower surface of the succeeding sheet $Sh_3$ but is held above the stacking tray 36 as it is. Such a phenomenon occurs due to a state in which a portion of the succeeding sheet $Sh_3$ downstream from the nip portion in the carry-out direction has hung downward together with the preceding sheet bundle Sb. The thus preceding sheet bundle Sb is forcibly separated from the lower surface of the succeeding sheet $Sh_3$ by a sheet separating operation to be described below and falls under its own weight to be placed on the stacking tray 36 located below.

According to the first mode of the sheet separating operation, as illustrated in FIG. 10A, a maximum downstream position MDP1 is set at a downstream-side position relatively near the lower conveyance roller 74. In this state, the auxiliary support member 56 is extended from the retracted position to a restriction position RP1 on a somewhat downstream side from the downstream end of the processing tray 51 (Step St7). The restriction position RP1 is set so that the distal end of the auxiliary support member 56 stops slightly behind or on the upstream side of the trailing edge of the sheet bundle Sb, and is extended on the downstream side from the nip position.

Next, the upper conveyance roller 73 and the lower conveyance roller 74 are rotated in the counterclockwise direction and the clockwise direction in FIG. 10B, respectively, to convey the upper-side succeeding sheet $Sh_3$ (and succeeding sheet $Sh_4$) to the upstream side (Step St8). The lower-side preceding sheet bundle Sb is thus urged to be moved toward the upstream side together with the succeeding sheet $Sh_3$. However, as illustrated in FIG. 10B, its trailing edge strikes against the distal end of the auxiliary support member 56 to limit the movement. Further, as a result of the operation of the auxiliary support member 56, a portion of the succeeding sheet $Sh_3$ downstream from the nip portion in the carry-out direction hangs down less easily than when the succeeding sheet $Sh_3$ is not supported on the auxiliary support member 56, which facilitates separation of the preceding sheet bundle Sb from the succeeding sheet $Sh_3$. Then, the succeeding sheet $Sh_3$ is conveyed to the upstream side as it is, which allows the preceding sheet bundle Sb to be forcibly separated from the succeeding sheet $Sh_3$, and the preceding sheet bundle Sb falls to be placed on the stacking tray 36 located below (Step St9).

According to the second mode of the sheet separating operation, as illustrated in FIG. 11A, a maximum downstream position MDP2 is set at a position slightly away from the lower conveyance roller 74 to the downstream side, on a more downstream side than in the case of FIG. 10A. In this state, the auxiliary support member 56 is extended in the same manner from the retracted position to a restriction position RP2 on a more downstream side than the downstream end of the processing tray 51 (Step St7). Also in the second mode, the restriction position RP2 is preferably set so that the distal end of the auxiliary support member 56 stops slightly behind or on the upstream side from the trailing edge of the sheet bundle Sb.

In the same manner, the upper conveyance roller 73 and the lower conveyance roller 74 are rotated in the counterclockwise direction and the clockwise direction in FIG. 11B, respectively, to convey the upper-side succeeding sheet $Sh_3$ to the upstream side (Step St8). The lower-side preceding sheet bundle Sb is thus urged to be moved toward the upstream side together with the succeeding sheet $Sh_3$. In this step, as illustrated in FIG. 11B, the distal end of the auxiliary support member 56 comes into contact with the trailing edge of the sheet bundle Sb to enter between the sheet bundle Sb and the lower surface of the succeeding sheet $Sh_3$. Such a configuration that the distal end surface of the auxiliary support member 56 comes into contact with the lower surface of the sheet $Sh_3$ in parallel or at an acute angle can facilitate entry of the auxiliary support member 56 between the succeeding sheet $Sh_3$ and the sheet bundle Sb. The succeeding sheet $Sh_3$ is conveyed to the upstream side in this state to also allow the preceding sheet bundle Sb to be forcibly separated from the succeeding sheet $Sh_3$ and fall to be placed on the stacking tray 36 under its own weight (Step St9).

According to the first mode of the sheet separating operation, the trailing edge position of the preceding sheet bundle Sb that may fall on the stacking tray 36 is restricted by the distal end position of the auxiliary support member 56 or the distal end position of the lower conveyance roller 74. According to the second mode of the sheet separating operation, the trailing edge position of the preceding sheet bundle Sb is restricted by the distal end position of the lower conveyance roller 74. In both the cases, the preceding sheet bundle Sb can be placed at a predetermined position on the stacking tray 36.

The number of succeeding sheets $Sh_3$ to be conveyed from the buffer path 90 may become smaller than the number of sheets in a bundle to be subsequently bound. In this case, after the end of the sheet separating operation and feeding of the succeeding sheet $Sh_3$ to the upstream end of the processing tray 51, a necessary number of additional succeeding sheets to be fed from the image forming apparatus A are discharged onto the processing tray as they are without being buffered. The additional succeeding sheets are aligned in position with the previous succeeding sheet $Sh_3$, as described above in connection with FIG. 7A to FIG. 7D.

According to the present invention, the mechanism of securely separating the preceding sheet (or bundle of sheets) from the succeeding sheet (or bundle of sheets) and discharging the sheet onto the stacking tray is not limited to the above-mentioned sheet conveying apparatus 37 according to the first embodiment but the sheet conveying apparatus 37 according to the first embodiment may be replaced by a sheet conveying apparatus according to a second embodiment to be described later. The sheet conveying apparatus according to the second embodiment will be described below.

Figure 15:
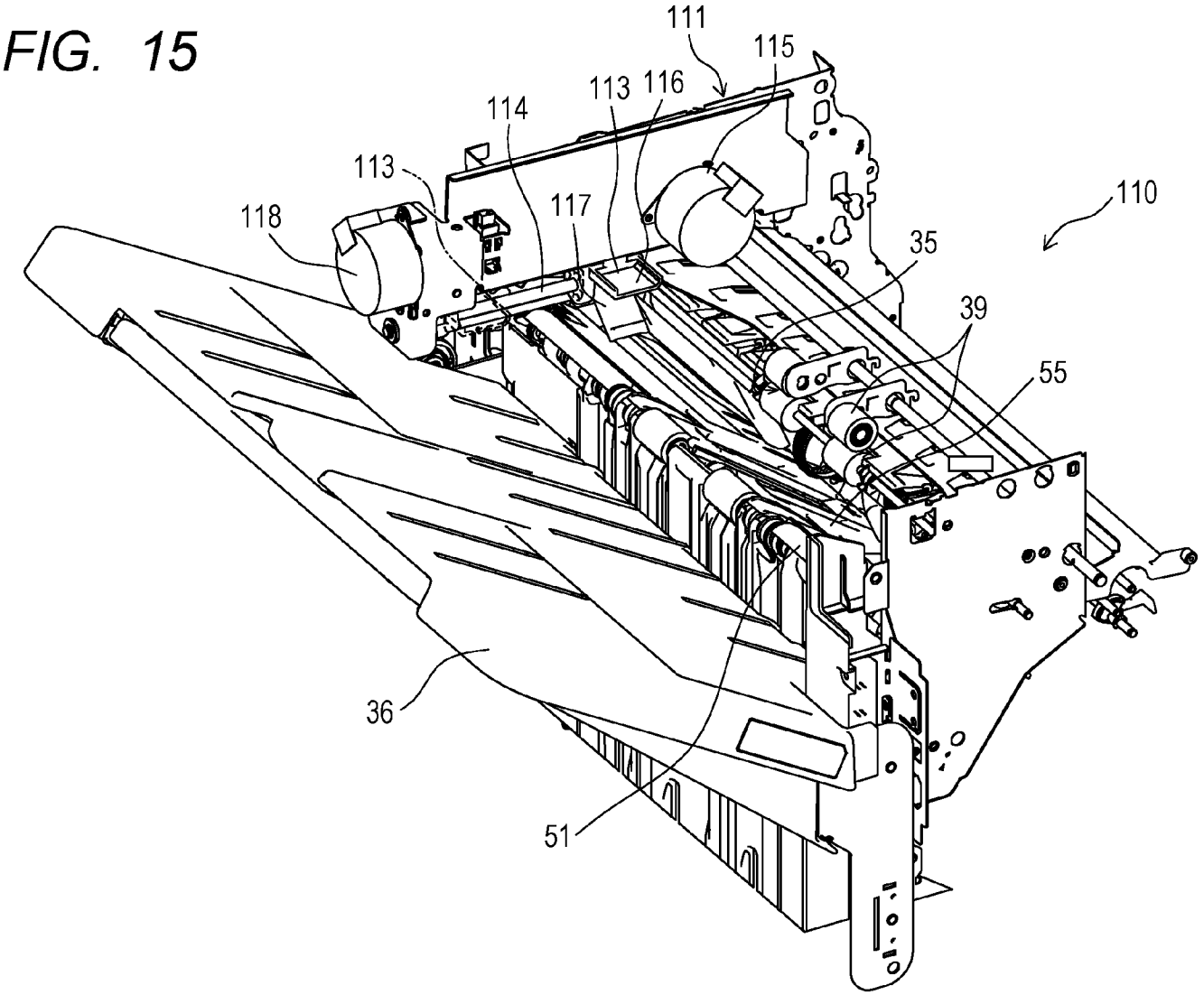
FIG. 15 is a schematic perspective view for illustrating a configuration of a sheet conveying apparatus according to a second embodiment of the present invention.
Figure 16:
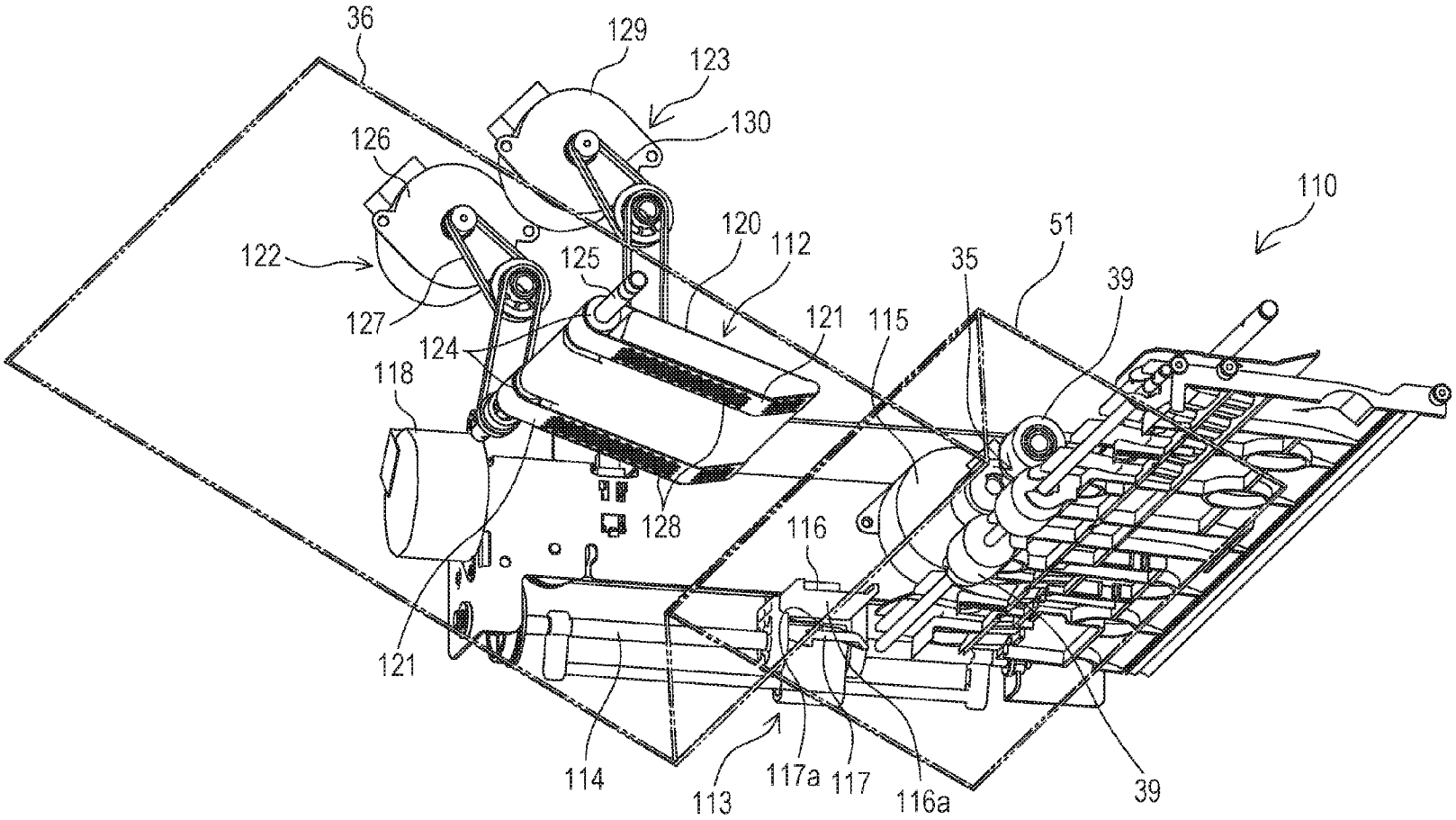
FIG. 16 is a schematic perspective view for illustrating a main part of the sheet conveying apparatus in FIG. 15 when viewed from obliquely below.

The structure of a sheet conveying apparatus 110 according to the second embodiment is schematically illustrated in FIG. 15 and FIG. 16. The sheet conveying apparatus 110 includes a gripper unit 111 instead of the conveyance roller apparatus 71 according to the first embodiment as a conveyance portion configured to convey a sheet discharged from the sheet discharge port 35 and/or a sheet (or bundle of sheets) on the processing tray 51 in both directions along the carry-out direction. Further, the sheet conveying apparatus 110 is different from the sheet conveying apparatus 37 according to the first embodiment in that the processing tray 51 does not include the auxiliary support member 56 according to the first embodiment but includes a suction unit (sheet attracting portion) 112 configured to attract a sheet from above on the downstream side of the processing tray 51 to support the sheet.

The gripper unit 111 includes a pair of grippers (gripper pair) 113 arranged on right and left so as to be opposed to each other above the processing tray 51 and in vicinities of both side ends of the processing tray 51 in its width direction. The grippers 113 are mounted on guide rods 114 extending substantially straight along both the side ends in the width direction above the processing tray 51 so as to be movable in both directions along the carry-out direction. As described later, a gripper drive motor (gripper moving unit) 115 is driven by the post-processing apparatus control portion arranged in the sheet post-processing apparatus B to move the grippers 113.

Each gripper 113 includes an upper gripper member 116 and a lower gripper member 117, which are formed of plate-like members radially extending from the guide rod 114, respectively. The upper gripper member 116 has a flat upper nipping surface 116*a* facing downward, which is fixed to the guide rod 114 in a circumferential direction and extends inward in the width direction from the guide rod 114. The lower gripper member 117 has a flat lower nipping surface 117*a*, which is swingably supported on the guide rod 114 in the circumferential direction and faces the upper nipping surface 116*a* when swung inward in the width direction and upward toward the upper gripper member 116.

The lower gripper member 117 can be swung between an open position at which the lower gripper member 117 faces vertically downward from the guide rod 114 and is substantially perpendicular to the upper gripper member 116, and a closed position at which the lower nipping surface 117*a* faces the upper nipping surface 116*a* in a surface-contactable manner. The lower gripper member 117 is turned to the closed position to allow the gripper 113 to grip a side end portion of a sheet (or bundle of sheets) from above and below between the upper nipping surface 116*a* and the lower nipping surface 117*a* so that the sheet is conveyable. A lower gripper member drive motor (gripper drive unit) 118 is driven by a post-processing apparatus control portion 188 to be described later to operate the lower gripper member 117.

According to the second embodiment, the gripper 113 can be moved between a most upstream position near an outlet of the sheet discharge port 35, which is indicated by a solid line in FIG. 15, and a most downstream position immediately on the downstream side from the processing tray 51, which is indicated by an imaginary line in FIG. 15. This allows the sheet discharged from the sheet discharge port 35 to be gripped at the most upstream position and to be conveyed in the carry-out direction to the most downstream position or a proper position behind the most downstream position, or to be conveyed in an opposite direction thereto. Further, the lower gripper members 117 are turned to the open position after the conveyance to allow the sheet to be released from the grippers 113 at the conveyance position.

In another mode, a part of the guide rod 114 of the gripper unit 111, in particular, its upstream-side portion can be arranged parallel to the sheet support surface 55 of the processing tray 51. This allows the sheet on the processing tray 51 to be conveyed along the sheet support surface 55 with both side end portions of the sheet gripped by the grippers 113.

The suction unit 112 is configured to apply a negative pressure through air suction to attract and convey the sheet, and as illustrated in FIG. 16, includes a relatively thin, rectangular box-shaped unit main body portion 120, and a pair of endless belts 121 arranged on right and left and stretched around both side portions in the width direction of the unit main body portion 120. The unit main body portion 120 has a suction fan (attraction force generating portion) 132 arranged inside, and its upstream-side end surface is inclined downward toward the downstream side. Further, the suction unit 112 includes a belt drive unit 122 configured to circumferentially move the endless belts 121, and a drive unit 123 of the suction fan 132.

The endless belt 121 is stretched between a drive pulley 124 and a driven pulley (not shown) mounted on a downstream end and an upstream end of the unit main body portion 120, respectively. The belt drive unit 122 includes a drive rod 125 in the width direction, which pivotally supports the drive pulley 124 to be rotatable together, an endless belt drive motor 126, and a belt transmission mechanism 127 connecting the drive rod 125 and the endless belt drive motor 126 to each other. The endless belt 121 circumferentially moves in both directions along the carry-out direction through forward and reverse rotations of the endless belt drive motor 126.

A surface of the endless belt 121 is perforated with a large number of small suction holes 128 substantially over the entire periphery, and the suction holes 128 communicate with a suction portion inside the unit main body portion 120 where the suction fan 132 is arranged. The drive unit 123 includes a suction fan drive motor 129, and a belt transmission mechanism 130 connecting the suction fan drive motor 129 to the suction fan 132. The suction fan 132 is rotated by the suction fan drive motor 129 to suck air into the inside from the suction holes 128, and an attraction force generated by the negative pressure allows the sheet to be attracted to a lower surface of the endless belt 121.

The endless belt 121 is circumferentially moved with the attraction force applied thereto, which allows the sheet attracted to the lower surface of the endless belt 121 to be conveyed along the carry-out direction. Further, the suction unit 112 according to the embodiment is arranged to be movable along the carry-out direction at least in a predetermined range. Therefore, the sheet can be conveyed without the need to circumferentially move the endless belt 121 through movement of the suction unit 112 itself using a suction unit drive motor 131 with the sheet attracted to the lower surface of the endless belt 121. Further, the conveying speed of the sheet can be increased through movement of the suction unit 112 using the suction unit drive motor 131 while circumferentially moving the endless belt 121.

A series of operations in the sheet conveying apparatus 110 according to the second embodiment up until discharge of a plurality of sheets having undergone post-processing onto the stacking tray 36 will be described below. According to a first mode of the second embodiment, a plurality of preceding sheets are stacked on the processing tray 51 as in the first embodiment and subjected to binding or another post-processing, and thereafter discharged to the stacking tray 36. According to a second mode, a plurality of preceding sheets are aligned, and thereafter discharged onto the stacking tray 36. The series of operations can be controlled by the post-processing apparatus control portion 188 of the sheet post-processing apparatus B to be described next.

Figure 17:
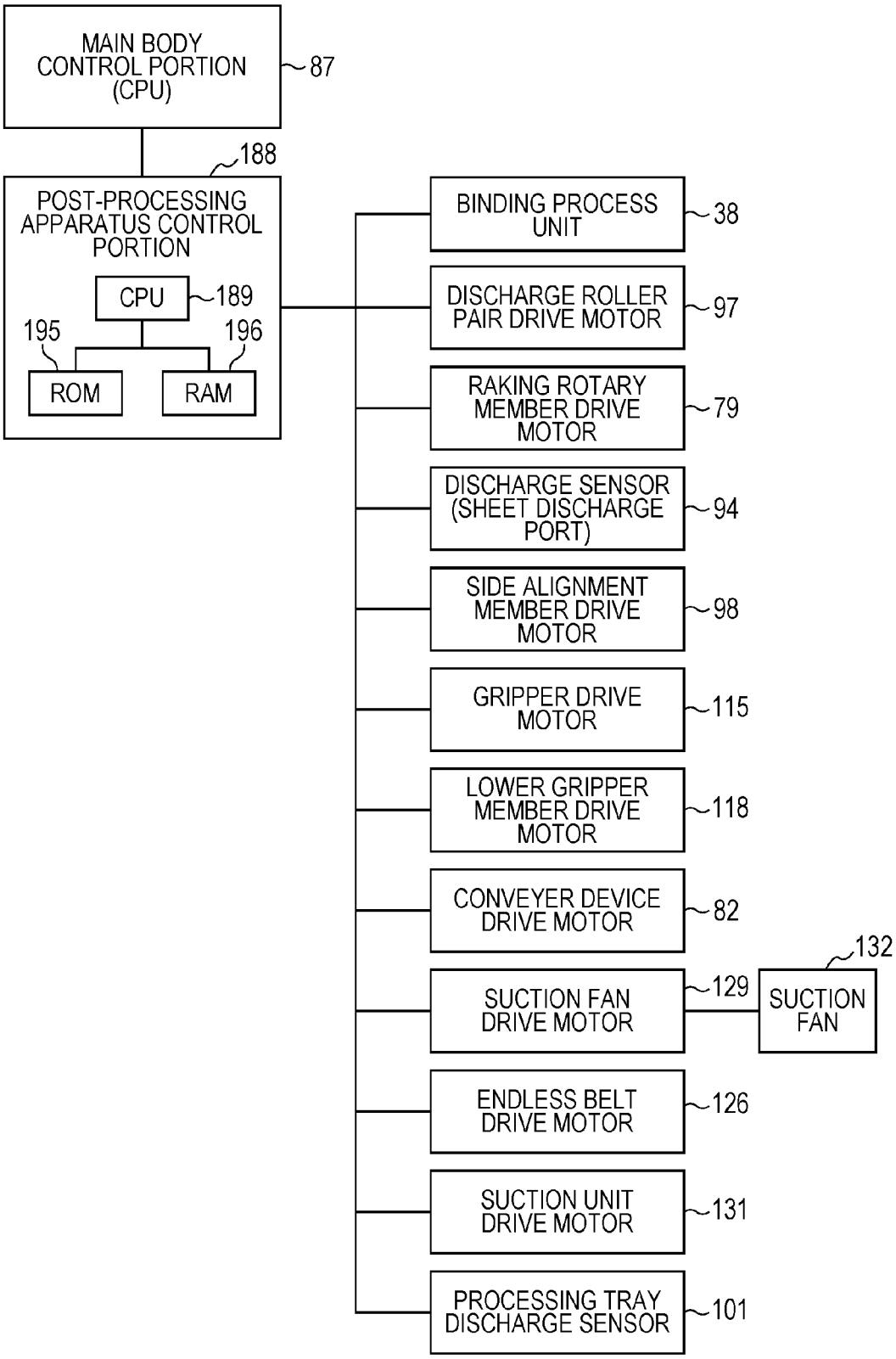
FIG. 17 is an explanatory view of the control structure in the sheet conveying apparatus according to the second embodiment of the present invention.

FIG. 17 is an illustration of the control structure of an image forming system including the sheet conveying apparatus 110 according to the second embodiment. The image forming system includes the main body control portion 87 of the image forming apparatus A and the post-processing apparatus control portion 188 of the sheet post-processing apparatus B, which is connected to the main body control portion 87. The main body control portion 87 provides, to the post-processing apparatus control portion 188, information on feeding of sheets from the image forming apparatus A to the sheet post-processing apparatus B. The post-processing apparatus control portion 188 includes a CPU 189, and a ROM 195 and a RAM 196 connected to the CPU 189, and executes post-processing in the first processing portion B1 based on a control program stored in the ROM 195 and control data stored in the RAM 196. Therefore, all of the drive motors and sensors described above in connection with the sheet conveying apparatus 110 according to the second embodiment are connected to the CPU 189 of the post-processing apparatus control portion 188 and the CPU 189 controls drive of the respective drive motors.

A process according to the first mode of the second embodiment, which involves simultaneously conveying preceding sheets on the processing tray 51 and a succeeding sheet overlaid thereon, separating the preceding sheets from the succeeding sheet, and placing the separated preceding sheets on the stacking tray 36, is schematically illustrated in FIG. 18A to FIG. 18D and FIG. 19A to FIG. 19D. FIG. 18A to FIG. 18D are views of the respective steps when viewed from a side along the carry-out direction, and FIG. 19A to FIG. 19D are views of the respective steps when viewed from the downstream side of the processing tray 51 in the carry-out direction.

Figure 18A:
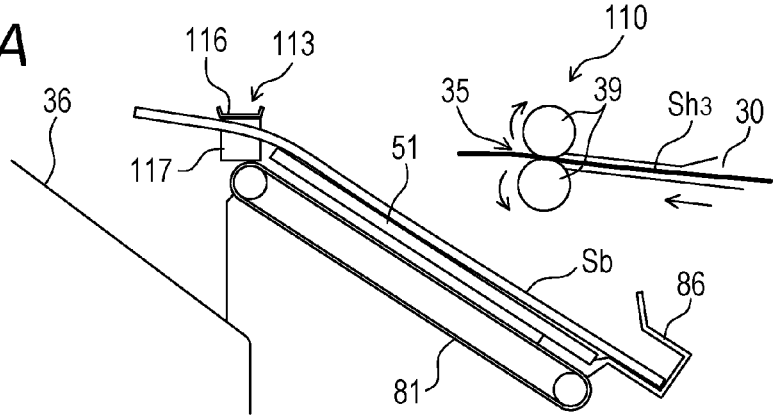
FIG. 18A, FIG. 18B, FIG. 18C, and FIG. 18D are schematic explanatory views for illustrating a process of simultaneously conveying a preceding sheet and its succeeding sheet to be discharged onto the stacking tray in a first mode.
Figure 19A:
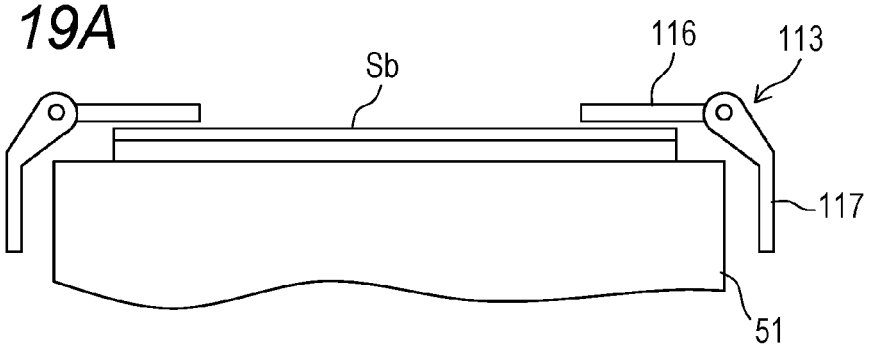
FIG. 19A, FIG. 19B, FIG. 19C, and FIG. 19D are schematic explanatory views of steps of FIG. 18A, FIG. 18B, FIG. 18C, and FIG. 18D, respectively, when viewed from a downstream-side front surface.

A state in which a sheet bundle Sb having a plurality of preceding sheets which are already post-processed is urged to be discharged onto the stacking tray 36 from the processing tray 51 is illustrated in FIG. 18A and FIG. 19A. In the gripper 113 of the gripper unit 111, the lower gripper member 117 is in the open position, and a downstream-side leading edge portion of the sheet bundle Sb is below the upper gripper member 116. In this step, the succeeding sheet $Sh_3$ is already being discharged above the processing tray 51 from the sheet discharge port 35 by the discharge roller pair 39.

Figure 18B:
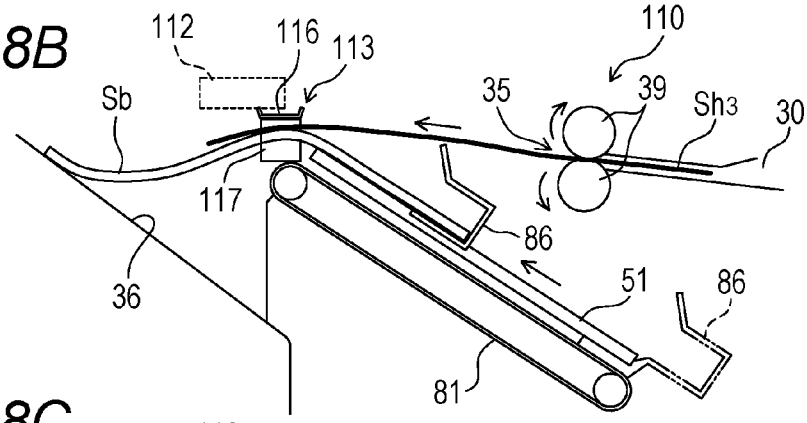
Figure 19B:
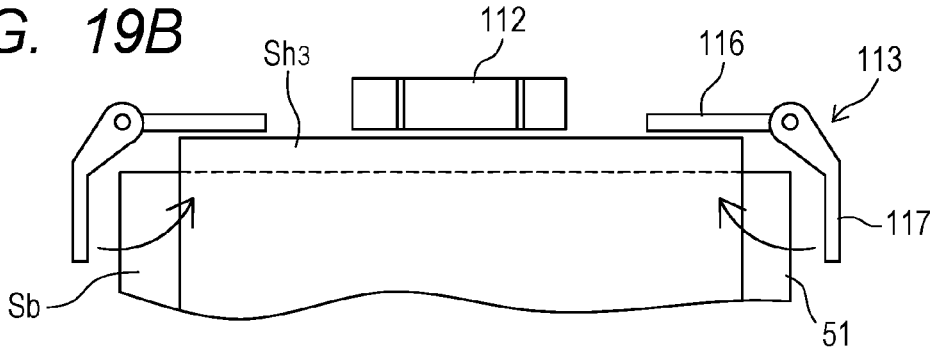

As illustrated in FIG. 18B and FIG. 19B, the sheet push-out member 86 of the conveyer device 81 is driven to convey the preceding sheet bundle Sb to its maximum push-out position in the carry-out direction. Also during conveyance of the sheet bundle Sb, the succeeding sheet $Sh_3$ is conveyed at a constant speed and a downstream-side leading edge portion of the succeeding sheet $Sh_3$ is overlaid on the sheet bundle Sb. According to the embodiment, at this moment, the downstream-side leading edge portion of the preceding sheet bundle Sb already reaches a placement surface of the stacking tray 36 and is supported thereon.

The lower gripper members 117 are rotated turned to be directed inward and upward in a state in which the succeeding sheet $Sh_3$ is thus overlaid on the preceding sheet bundle Sb and a leading edge of the succeeding sheet $Sh_3$ travels up to a position having passed under the upper gripper member 116, thereby gripping both side end portions of the sheet bundle Sb and the sheet $Sh_3$ between the upper gripper members 116 and the lower gripper members 117. The gripper 113 grips the sheet bundle Sb and the sheet $Sh_3$ while simultaneously moving the sheet bundle Sb and the sheet $Sh_3$ to the downstream side at the same speed as the sheet conveying speed of the discharge roller pair 39. Slacking, wrinkling, and an excessively pulled state of the sheet bundle Sb and the sheet $Sh_3$ can be avoided between the gripper 113 and the discharge roller pair 39 through such movement of the gripper 113.

At this moment, a positional displacement occurs in the carry-out direction between the preceding sheet bundle Sb and the succeeding sheet $Sh_3$. A timing at which the sheet bundle Sb and the sheet $Sh_3$ are gripped by the gripper 113 is determined so that the displacement amount L substantially matches with a predetermined value or falls within a predetermined value range. For example, if the downstream-side leading edge portion of the sheet $Sh_3$ has passed under the upper gripper member 116 when the sheet bundle Sb is conveyed to the maximum push-out position by the sheet push-out member 86, the gripper 113 can be operated simultaneously therewith to grip the sheet bundle Sb and the sheet $Sh_3$, thus starting their movement. It is also possible to grip the sheet bundle Sb and the sheet $Sh_3$ while waiting for the sheet $Sh_3$ to travel to the downstream side by a certain distance after the sheet bundle Sb is conveyed to the maximum push-out position.

Figure 18C:
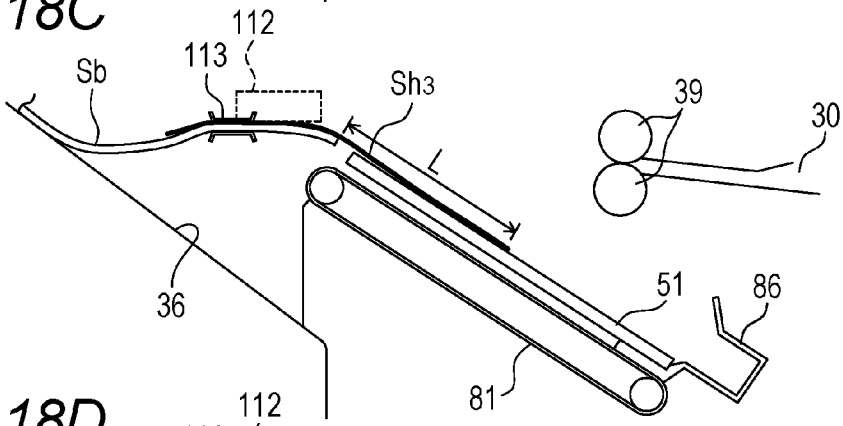
Figure 19C:
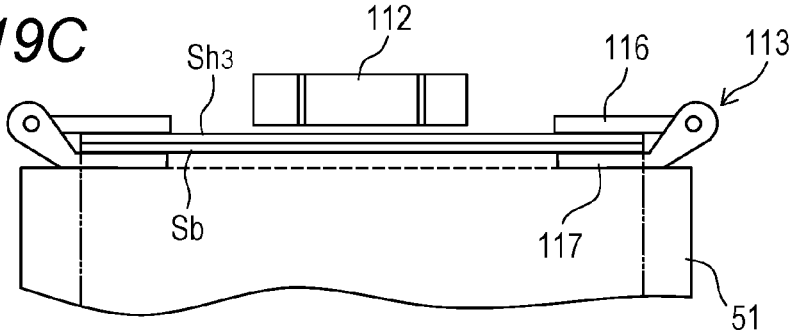

When the trailing edge, that is, the upstream edge of the preceding sheet bundle Sb reaches a position slightly beyond the downstream end of the processing tray 51, the movement of the gripper 113 is stopped, as illustrated in FIG. 18C and FIG. 19C. This position is a position where the sheet bundle Sb may fall to be placed on the stacking tray 36 located below if the sheet bundle Sb is not gripped by the gripper 113 or if the sheet bundle Sb is not gripped by the gripper 113 and is not attracted to the upper-side sheet $Sh_3$ sufficiently forcefully.

After the sheet bundle Sb and the sheet $Sh_3$ are gripped by the gripper 113 and before the sheet bundle Sb and the sheet $Sh_3$ are conveyed to a position illustrated in FIG. 18C and FIG. 19C where the sheet bundle Sb and the sheet $Sh_3$ can fall on the stacking tray 36, the suction unit 112 is operated to attract the upper surface of the sheet $Sh_3$ at an uppermost position. Attraction of the sheet $Sh_3$ can be started at a position where the sheet bundle Sb and the sheet $Sh_3$ are placed on the lower surface of the unit main body portion 120 when at least the downstream-side leading edge of the sheet $Sh_3$ enters the lower surface of the unit main body portion 120. Of course, attraction of the sheet $Sh_3$ may be started at a position where the downstream-side leading edge of the sheet $Sh_3$ has passed under the lower surface of the unit main body portion 120.

During conveyance of the sheet bundle Sb and the sheet $Sh_3$, the suction unit 112 is kept at a predetermined position slightly on the downstream side from the processing tray 51, as illustrated in FIG. 18C. Therefore, the endless belt 121 is circumferentially moved at the same speed as the conveying speeds of the discharge roller pair 39 and the gripper 113. The sheet $Sh_3$ can be thus smoothly conveyed in a uniformly smooth state without causing slacking, wrinkling, folding, or an excessively pulled state between a portion of the sheet $Sh_3$ attracted by the suction unit 112 and its peripheral portion.

In this step, the attraction force of the suction unit 112 is set to a sufficient magnitude to prevent at least the sheet $Sh_3$ and the sheet bundle Sb from falling down even when the sheet bundle Sb is integral with the sheet $Sh_3$ by, for example, electrostatic attraction. The post-processing apparatus control portion 188 drives the suction fan 132 inside the unit main body portion 120 with the suction fan drive motor 129 and controls its number of rotations, which allows the attraction force of the suction unit 112 to be adjusted. Further, the post-processing apparatus control portion 188 can change the number of rotations of the suction fan 132 during its operation to allow the attraction force acting on the sheet $Sh_3$ to be increased or decreased.

Figure 18D:
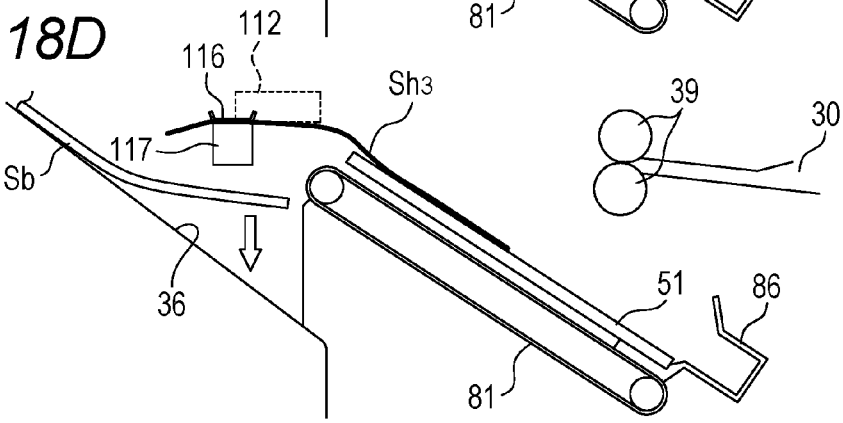
Figure 19D:
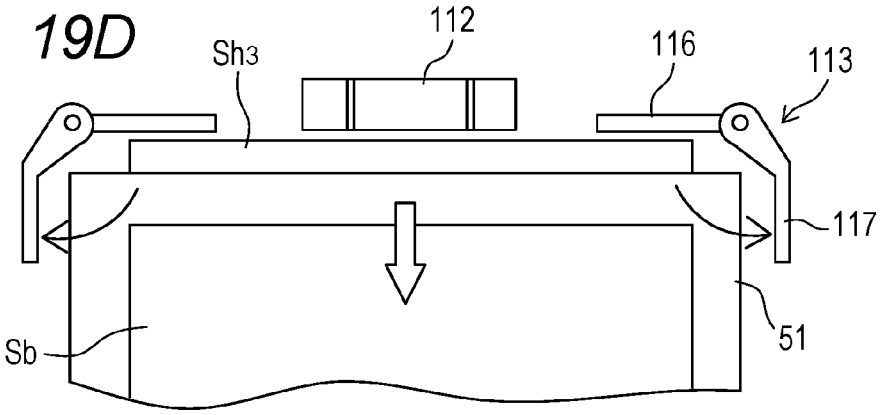

Next, as illustrated in FIG. 18D and FIG. 19D, the gripper 113 is operated so that the lower gripper member 117 completely opens downward. The preceding sheet bundle Sb is thus completely released from the gripper 113 configured to restrict downward falling. The upper-side sheet $Sh_3$ remains held in a state of being attracted by the suction unit 112.

When the lower-side sheet bundle Sb is not attracted to the lower surface of the sheet $Sh_3$ or when the attraction force is relatively low, the lower-side sheet bundle Sb is immediately separated from the upper-side sheet $Sh_3$ under its own weight and falls to be placed on the stacking tray 36. Even when the sheet bundle Sb is attracted to the lower surface of the sheet $Sh_3$ with a certain degree of force, as a result of an action that the downstream-side leading edge portion of the sheet bundle Sb supported on the placement surface of the stacking tray 36 slides downward under its own weight on the placement surface which is inclined to some extent as illustrated in FIG. 18D, the sheet bundle Sb is separated from the lower surface of the sheet $Sh_3$. The sheet bundle Sb is thus separated from the upper-side sheet $Sh_3$ and falls to be placed on the stacking tray 36.

When the sheet bundle Sb is not easily separated from the sheet $Sh_3$, the unit main body portion 120 of the suction unit 112 is inclined back and forth in the carry-out direction, which allows the sheet bundle Sb to be easily separated from the lower surface of the sheet $Sh_3$ under the own weight of the portion of the sheet bundle Sb on the downstream side from the sheet $Sh_3$. According to another embodiment of the present invention, the unit main body portion 120 is previously set to be inclined while completely opening the lower gripper member 117 downward simultaneously in FIG. 18D and FIG. 19D so that the sheet bundle Sb can always be securely separated from the sheet $Sh_3$ and fall to be placed on the stacking tray 36.

The succeeding sheet $Sh_3$ from which the preceding sheet bundle Sb has been separated is conveyed onto the processing tray 51 by the suction unit 112. Conveyance onto the processing tray 51 is performed by reversing the endless belt 121 with the sheet $Sh_3$ kept attracted and conveying the sheet $Sh_3$ in an opposite direction to the carry-out direction. Further, the sheet $Sh_3$ may also be conveyed onto the processing tray 51 by closing the lower gripper members 117 to grip both side end portions of the sheet $Sh_3$, returning the grippers 113 to an original position in the vicinity of the downstream end of the processing tray 51, and opening the lower gripper members 117.

According to the second mode of the second embodiment, after the plurality of preceding sheets are aligned, a succeeding sheet is overlaid on the preceding sheets, and the preceding sheets and the succeeding sheet are simultaneously conveyed. Then, the preceding sheets are separated from the succeeding sheet and placed on the stacking tray 36. A process involving aligning the plurality of preceding sheets and overlaying the succeeding sheet thereon is illustrated in FIG. 20A to FIG. 20D. A process involving separating the preceding sheets from the simultaneously conveyed succeeding sheet and placing the separated preceding sheets on the stacking tray 36 is illustrated in FIG. 21A to FIG. 21D and FIG. 22A to FIG. 22D. FIG. 20A to FIG. 20D and FIG. 21A to FIG. 21D are views of the respective steps when viewed from a side along the carry-out direction, and FIG. 22A to FIG. 22D are views of the respective steps when viewed from the downstream side of the processing tray 51 in the carry-out direction.

First, a first sheet $Sh_1$ is switchback-conveyed in the same manner as the succeeding sheet $Sh_3$ buffered in FIG. 8A to FIG. 8E in the first embodiment and is caused to remain in the buffer path 90. The sheet $Sh_1$ is held at a predetermined buffer position in the buffer path 90 with its downstream edge positioned in the vicinity of the inlet of the first sheet discharge path 30 and nipped by the conveyance roller pair 91.

Figure 20A:
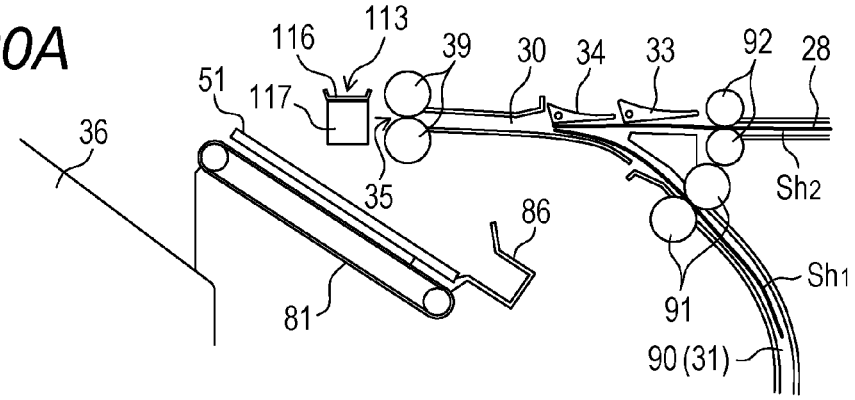
FIG. 20A, FIG. 20B, FIG. 20C, and FIG. 20D are schematic explanatory views for illustrating a process of overlaying a succeeding sheet on a preceding sheet according to a second mode.

When a succeeding sheet $Sh_2$ is conveyed along the sheet carry-in passage 28 and its downstream-side leading edge enters the first sheet discharge path 30, and as illustrated in FIG. 20A, reaches a position matching with the downstream edge of the first sheet $Sh_1$ located at the buffer position, the conveyance roller pair 91 is rotated to convey the sheet $Sh_1$ to the first sheet discharge path from the buffer path 90. The conveying speed of the conveyance roller pair 91 is the same as that of the conveyance roller pair 92 of the sheet carry-in passage 28 configured to convey the sheet $Sh_2$. The sheet $Sh_1$ and the sheet $Sh_2$ are conveyed toward the stopping discharge roller pair 39 in an overlaid state inside the first sheet discharge path 30.

Figure 20B:
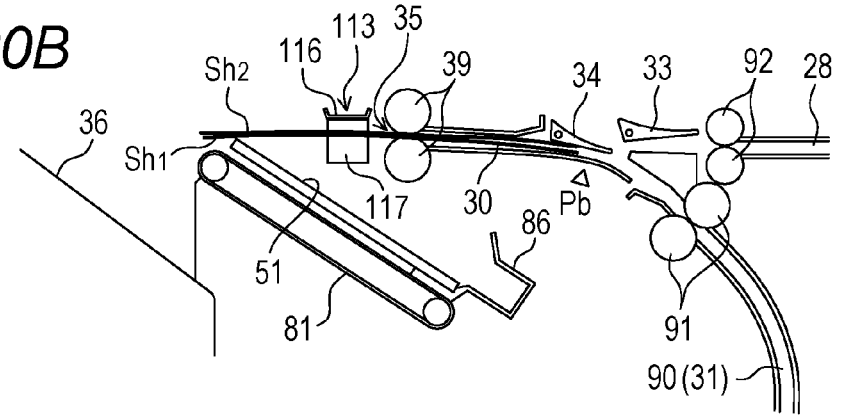

After the sheet $Sh_1$ and the sheet $Sh_2$ are aligned in their leading edge positions by the discharge roller pair 39, the discharge roller pair 39 is rotated to nip both the sheets therebetween, to convey the sheets in the carry-out direction, and to partially discharge the sheets from the sheet discharge port 35. When the trailing edge positions of the sheet $Sh_1$ and the sheet $Sh_2$ reach the switchback position Pb in the first sheet discharge path 30, as illustrated in FIG. 20B, the second path-switching apparatus 34 is closed and the discharge roller pair 39 is reversed so that the sheet $Sh_1$ and the sheet $Sh_2$ are switchback-conveyed and fed into the buffer path 90. The sheet $Sh_1$ and the sheet $Sh_2$ conveyed to the buffer path 90 are nipped by the conveyance roller pair 91 and are conveyed to and held at the predetermined buffer position.

Figure 20C:
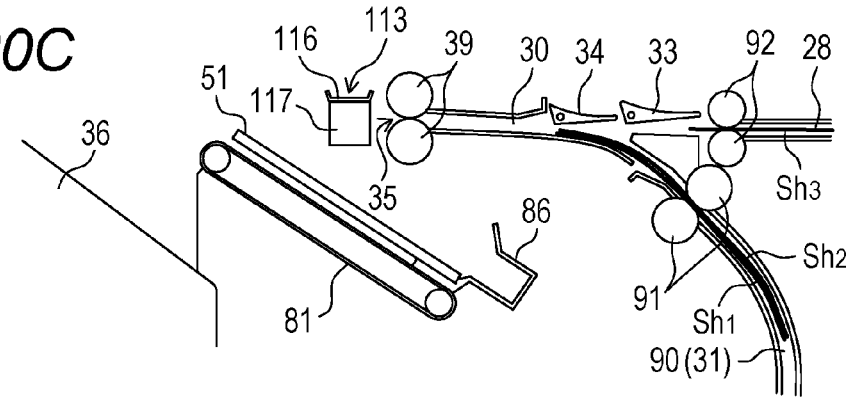

The series of steps is repeated to allow a predetermined number of preceding sheets $Sh_1$ and $Sh_2$ to be aligned in position in the carry-out direction and to remain inside the buffer path 90, as illustrated in FIG. 20C. Next, when the succeeding sheet $Sh_3$ is conveyed along the sheet carry-in passage 28 with the second path-switching apparatus 34 being opened, the conveyance roller pair 91 is rotated to convey the preceding sheets $Sh_1$ and $Sh_2$ to the first sheet discharge path 30 before the succeeding sheet $Sh_3$.

Figure 20D:
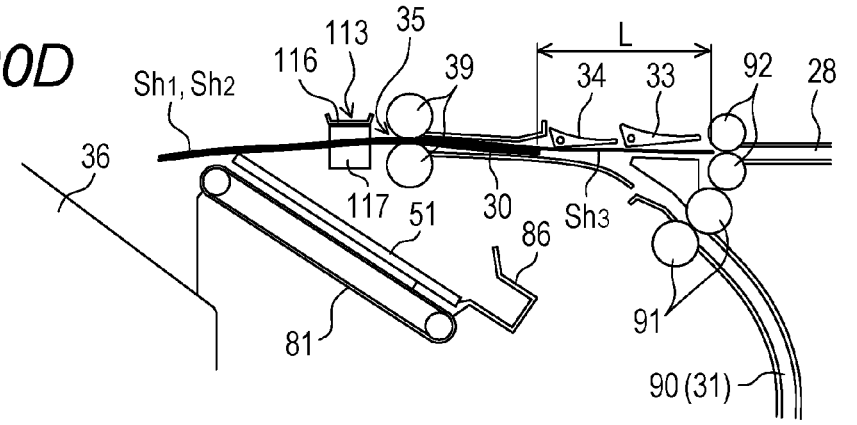

The succeeding sheet $Sh_3$ is overlaid on the preceding sheets $Sh_1$ and $Sh_2$ in the first sheet discharge path 30 and is simultaneously conveyed in the carry-out direction by the discharge roller pair 39 together with the preceding sheets $Sh_1$ and $Sh_2$, as illustrated in FIG. 20D. In this step, a positional displacement occurs in the carry-out direction between the preceding sheets $Sh_1$ and $Sh_2$ and the succeeding sheet $Sh_3$. A timing at which the preceding sheets $Sh_1$ and $Sh_2$ are conveyed to the first sheet discharge path 30 from the buffer position is determined so that the displacement amount L substantially matches with a predetermined value or falls within a predetermined value range.

Figure 21A:
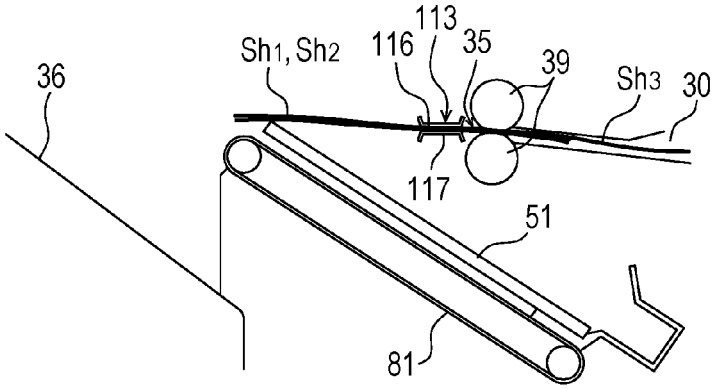
FIG. 21A, FIG. 21B, FIG. 21C, and FIG. 21D are schematic explanatory views for illustrating a process of simultaneously conveying a preceding sheet and its succeeding sheet to be discharged onto the stacking tray in the second mode.
Figure 22A:
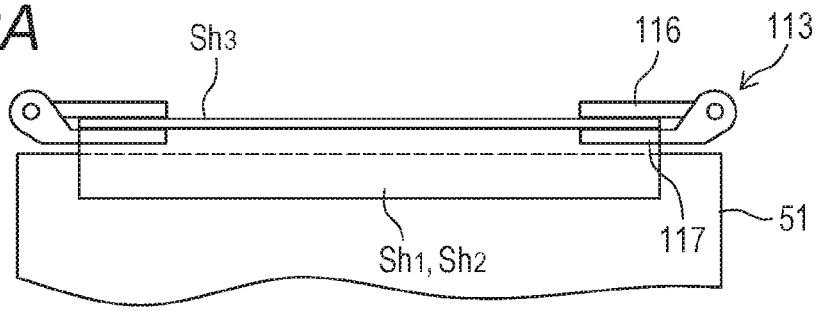
FIG. 22A, FIG. 22B, FIG. 22C, and FIG. 22D are schematic explanatory views of steps of FIG. 21A, FIG. 21B, FIG. 21C, and FIG. 21D, respectively, when viewed from a downstream-side front surface.

In a vicinity of the outlet of the sheet discharge port 35 through which the preceding sheets $Sh_1$ and $Sh_2$ and the succeeding sheet $Sh_3$ are thus simultaneously discharged, the gripper 113 of the gripper unit 111 is waiting in a state of being opened at the same height as the height of the sheet discharge port 35. When the succeeding sheet $Sh_3$ travels to a certain position on the downstream side with the leading edge of the succeeding sheet $Sh_3$ passing under the upper gripper member 116, as illustrated in FIG. 21A and FIG. 22A, the lower gripper members 117 are turned to be directed inward and upward to grip both side end portions of the sheets $Sh_1$ and $Sh_2$ and the sheet $Sh_3$ between the upper gripper members 116 and the lower gripper members 117.

The gripper 113 grips the sheets $Sh_1$ and $Sh_2$ and the sheet $Sh_3$ while simultaneously moving the sheets $Sh_1$ and $Sh_2$ and the sheet $Sh_3$ to the downstream side at the same speed as the sheet conveying speed of the discharge roller pair 39. Occurrence of slacking and wrinkling, and an excessively pulled state of the preceding sheets $Sh_1$ and $Sh_2$ and the succeeding sheet $Sh_3$ between the gripper 113 and the discharge roller pair 39 can be thus avoided.

Figure 21B:
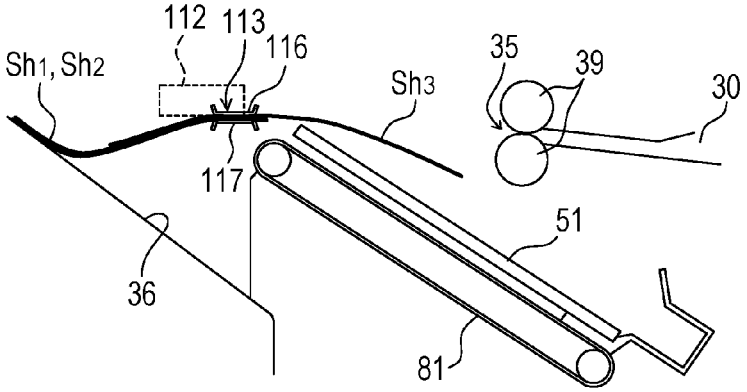
Figure 22B:
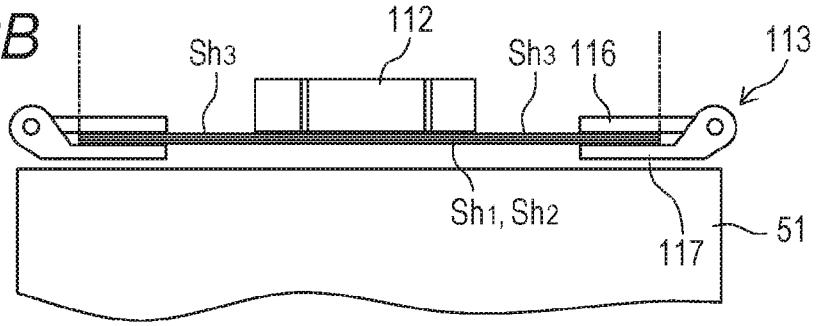

When the trailing edges, that is, the upstream edges of the preceding sheets $Sh_1$ and $Sh_2$ reach a position slightly beyond the downstream end of the processing tray 51, the movement of the gripper 113 is stopped, as illustrated in FIG. 21B and FIG. 22B. This position is a position where the sheets $Sh_1$ and $Sh_2$ may fall to be placed on the stacking tray 36 located below if the sheets $Sh_1$ and $Sh_2$ are not gripped by the gripper 113 or if the sheets $Sh_1$ and $Sh_2$ are not gripped by the gripper 113 and are not attracted to the upper-side sheet $Sh_3$ sufficiently forcefully.

After the sheets $Sh_1$ and $Sh_2$ and the sheet $Sh_3$ are gripped by the gripper 113 and before the sheets $Sh_1$ and $Sh_2$ and the sheet $Sh_3$ are conveyed to a position illustrated in FIG. 21B and FIG. 22B where the sheets $Sh_1$ and $Sh_2$ can fall on the stacking tray, the suction unit 112 is operated to attract the upper surface of the sheet $Sh_3$ at an uppermost position. Attraction of the sheet $Sh_3$ can be started at a position where the sheet $Sh_2$ and the sheet $Sh_3$ are placed on the lower surface of the unit main body portion 120 when at least the downstream-side leading edge of the sheet $Sh_3$ enters the lower surface of the unit main body portion 120. Further, attraction of the sheet $Sh_3$ may be started at a position where the downstream-side leading edge of the sheet $Sh_3$ has passed under the lower surface of the unit main body portion 120.

The suction unit 112 is kept at a predetermined position slightly on the downstream side from the processing tray 51 as in the first mode of the second embodiment. Therefore, the endless belt 121 is circumferentially moved at the same speed as the conveying speed during conveyance of the sheets $Sh_1$ and $Sh_2$ and the sheet $Sh_3$ using the gripper 113. The sheet $Sh_3$ can be thus smoothly conveyed in a uniformly smooth state without causing slacking, wrinkling, folding, or an excessively pulled state between a portion of the sheet $Sh_3$ attracted by the suction unit 112 and its peripheral portion.

Also in the second mode, the attraction force of the suction unit 112 is adjusted to a sufficient magnitude to prevent at least the sheet $Sh_3$ and the sheets $Sh_1$ and $Sh_2$ electrostatically attracted to the sheet $Sh_3$ from falling down using the post-processing apparatus control portion 188. Further, the attraction force of the suction unit 112 can be increased or decreased by the post-processing apparatus control portion 118 during its operation.

Figure 21C:
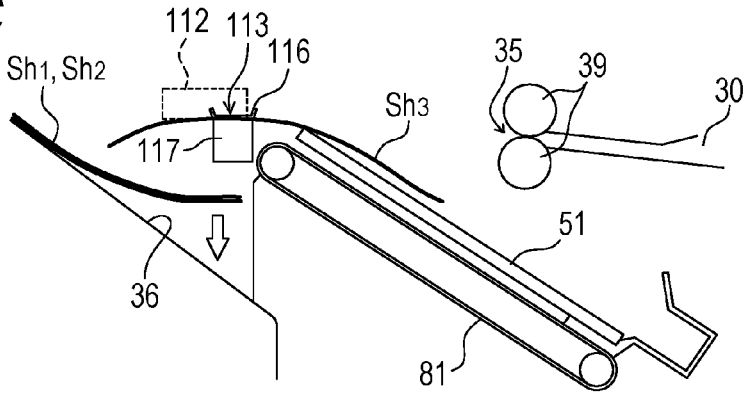
Figure 21D:
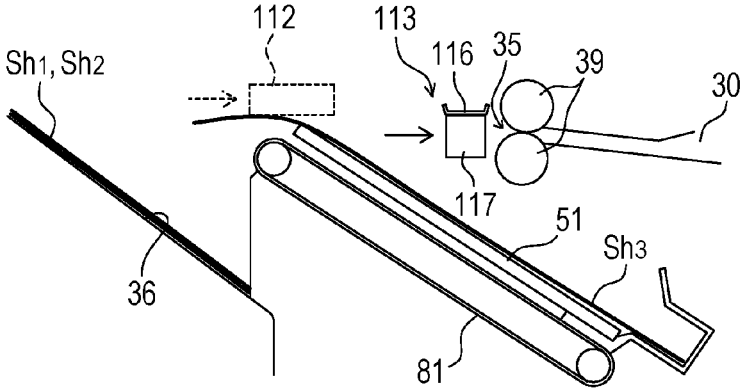
Figure 22C:
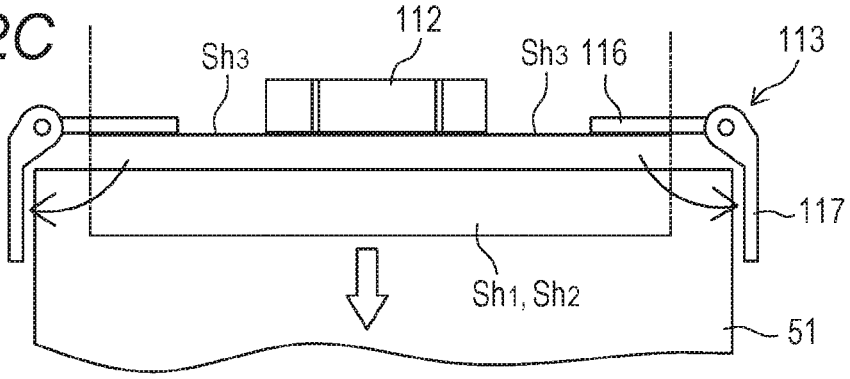
Figure 22D:
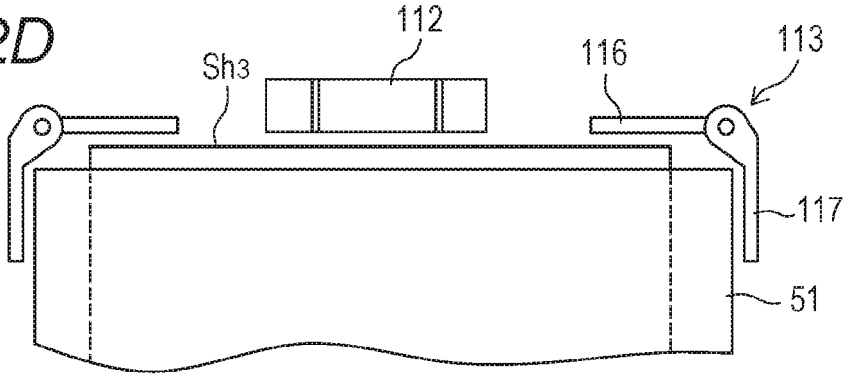

Next, as illustrated in FIG. 21C and FIG. 22C, the gripper 113 is operated so that the lower gripper member 117 completely opens downward. The preceding sheets $Sh_1$ and $Sh_2$ are thus completely released from the gripper 113 configured to restrict downward falling. The upper-side sheet $Sh_3$ remains held in a state of being attracted by the suction unit 112.

When the lower-side sheets $Sh_1$ and $Sh_2$ are not attracted to the lower surface of the sheet $Sh_3$ or when the attraction force is relatively low, the lower-side sheets $Sh_1$ and $Sh_2$ are immediately separated from the upper-side sheet $Sh_3$ under their own weight and fall to be placed on the stacking tray 36. Even when the sheets $Sh_1$ and $Sh_2$ are attracted to the lower surface of the sheet $Sh_3$ with a certain degree of force, as a result of an action that the downstream-side leading edge portions of the sheets $Sh_1$ and $Sh_2$ supported on the placement surface of the stacking tray 36 slide downward under their own weight on the placement surface which is inclined to some extent, the sheets $Sh_1$ and $Sh_2$ are separated from the lower surface of the sheet $Sh_3$. The sheets $Sh_1$ and $Sh_2$ are thus separated from the upper-side sheet $Sh_3$ and fall to be placed on the stacking tray 36.

When the preceding sheets $Sh_1$ and $Sh_2$ are not easily separated from the succeeding sheet $Sh_3$, the unit main body portion 120 of the suction unit 112 is inclined back and forth in the carry-out direction, which allows the preceding sheets $Sh_1$ and $Sh_2$ to be easily separated from the lower surface of the sheet $Sh_3$. Further, the unit main body portion 120 may be previously set to be inclined as soon as the lower gripper member 117 is completely opened downward in FIG. 21C and FIG. 22C so that the sheets $Sh_1$ and $Sh_2$ are always securely separated from the sheet $Sh_3$ and fall to be placed on the stacking tray 36.

The succeeding sheet Sh3 from which the preceding sheets $Sh_1$ and $Sh_2$ have been separated is conveyed onto the processing tray 51. Conveyance onto the processing tray 51 is performed by moving the suction unit 112 toward the processing tray 51 with the sheet $Sh_3$ kept attracted, or reversing the endless belt 121 and conveying the sheet $Sh_3$ in an opposite direction to the carry-out direction. Further, the sheet $Sh_3$ may also be conveyed onto the processing tray 51 by closing the lower gripper members 117 to grip both side ends of the sheet $Sh_3$, and opening the lower gripper members 117 in the process of returning the grippers 113 to the original position in the vicinity of the sheet discharge port 35.

The present invention has been described above with reference to exemplary embodiments. However, it goes without saying that the present invention is not limited to those embodiments but may be carried out by adding various modifications and changes within the technical scope of the present invention. For example, an apparatus making use of electrostatic attraction may be used in the suction unit according to the second embodiment.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-178019, filed Sep. 9, 2015, which is hereby incorporated by reference herein in its entirety.

What is claimed is:

1. A sheet conveying apparatus, comprising:

a pair of rollers configured to nip and convey a plurality of sheets in a predetermined direction, the plurality of sheets being overlaid on top of each other, the plurality of sheets including a first sheet and a second sheet, the first sheet being located undermost among the plurality of sheets, the second sheet being different from the first sheet, and an upstream edge of the first sheet being located downstream of an upstream edge of the second sheet in the predetermined direction when the pair of rollers is conveying the plurality of sheets;

a placement portion on which the plurality of sheets conveyed by the pair of rollers is placed;

a support portion configured to support the second sheet when the first sheet is located at a position at which the first sheet is placeable on the placement portion;

a support member configured to be movable to a first position and to a second position, a downstream end, with respect to the predetermined direction, of the support member being located, in a case where the support member is located at the first position, downstream, with respect to the predetermined direction, of a downstream end, with respect to the predetermined direction, of a support area at which the support portion supports the second sheet, the downstream end of the support member being located, in a case where the support member is located at the second position, upstream, with respect to the predetermined direction, of the downstream end of the support member which is located at the first position, a first state being a state that the support member is located at the first position to support a lower surface of the second sheet without supporting a lower surface of the first sheet, a second state being a state that the support member is located at the second position not to support the lower surface of the first sheet which has passed through a nip in which the pair of rollers nip sheets; and a control portion configured to, in a state in which the upstream edge, with respect to the predetermined direction, of the first sheet has passed through the nip and the second sheet is being nipped by the pair of rollers, bring the support member into the second state in which the support member is located at the second position, and after bringing the support member into the second state, bring the support member into the first state in which the support member is located at the first position.

2. A sheet conveying apparatus according to claim 1, wherein a moving range of the support member overlaps with an outer periphery of a lower roller of the pair of rollers as viewed from a direction perpendicular to the predetermined direction.

3. A sheet conveying apparatus according to claim 2, wherein the support member comprises a plurality of support members, and the plurality of support members are arranged on both sides of the pair of rollers in the direction perpendicular to the predetermined direction.

4. A sheet conveying apparatus according to claim 1, wherein the pair of rollers is configured to convey the second sheet in a direction opposite to the predetermined direction, and wherein the control portion is configured to locate the support member at the first position when the second sheet is being conveyed in the opposite direction.

5. A sheet conveying apparatus according to claim 4, wherein the plurality of support members each have a curved support surface configured to restrict from below the plurality of sheets nipped by the pair of rollers.

6. A sheet conveying apparatus according to claim 1, further comprising:

an abutment member configured to abut the upstream edge, with respect to the predetermined direction, of the first sheet supported by the support portion; and a conveyance portion configured to convey the first sheet supported by the support portion so as to cause the upstream edge, with respect to the predetermined direction, of the first sheet to abut against the abutment member, wherein the support member is configured to move to a third position at which the downstream end, with respect to the predetermined direction, of the support member is located downstream, with respect to the predetermined direction, of the first position, and wherein the control portion causes the support member to be located at the third position in a case where the conveyance portion causes the first sheet supported by the support portion to abut against the abutment member.

7. A sheet conveying apparatus according to claim 6, wherein the control portion causes the support member to move from the third position to the second position by a time the upstream edge, with respect to the predetermined direction, of the first sheet passes through the nip.

8. A sheet conveying apparatus according to claim 1, wherein the control portion causes the support member to be located at the second position by a time the upstream edge, with respect to the predetermined direction, of the first sheet passes through the nip.

9. An image forming system, comprising:

an image forming unit configured to form an image on a sheet; and a sheet conveying apparatus configured to convey a plurality of sheets conveyed from the image forming unit, the sheet conveying apparatus comprising:

a pair of rollers configured to nip and convey the plurality of sheets in a predetermined direction, the plurality of sheets being overlaid on top of each other, the plurality of sheets including a first sheet and a second sheet, the first sheet being located undermost among the plurality of sheets, the second sheet being different from the first sheet, and an upstream edge of the first sheet being located downstream of an upstream edge of the second sheet in the predetermined direction when the pair of rollers is conveying the plurality of sheets;

a placement portion on which the plurality of sheets conveyed by the pair of rollers is placed;

a support portion configured to support the second sheet when the first sheet is located at a position at which the first sheet is placeable on the placement portion;

a support member configured to be movable to a first position and to a second position, a downstream end, with respect to the predetermined direction, of the support member being located, in a case where the support member is located at the first position, downstream, with respect to the predetermined direction, of a downstream end, with respect to the predetermined direction, of a support area at which the support portion supports the second sheet, the downstream end of the support member being located, in a case where the support member is located at the second position, upstream, with respect to the predetermined direction, of the downstream end of the support member which is located at the first position, a first state being a state that the support member is located at the first position to support a lower surface of the second sheet without supporting a lower surface of the first sheet, a second state being a state that the support member is located at the second position not to support the lower surface of the first sheet which has passed through a nip in which the pair of rollers nip sheets; and a control portion configured to, in a state in which the upstream edge, with respect to the predetermined direction, of the first sheet has passed through the nip and the second sheet is being nipped by the pair of rollers, bring the support member into the second state in which the support member is located at the second position, and after bringing the support member into the second state, bring the support member into the first state in which the support member is located at the first position.

* * * * *